US005647281A

United States Patent [19]

Kunczynski

[11] Patent Number: 5,647,281

[45] Date of Patent: Jul. 15, 1997

[54] SEMI-RIGID, FIN-BASED TRANSPORTATION SYSTEM

[75] Inventor: Jan K. Kunczynski, Glenbrook, Nev.

[73] Assignee: Yantrak, LLC, Carson City, Nev.

[21] Appl. No.: 524,063

[22] Filed: Sep. 6, 1995

[51] Int. Cl.[6] ..... B61B 13/00

[52] U.S. Cl. ..... 104/168; 104/119; 104/243; 105/144

[58] Field of Search ..... 104/118, 119, 104/163, 168, 243; 105/141, 144

[56] References Cited

U.S. PATENT DOCUMENTS

| | | | |
|---|---|---|---|
| 3,537,402 | 11/1970 | Harkess | 104/168 |
| 3,584,583 | 6/1971 | Cartwright | 104/119 |
| 3,848,535 | 11/1974 | Mitchell | 104/168 |
| 3,880,088 | 4/1975 | Grant | 104/168 |
| 4,232,611 | 11/1980 | Uozumi | 104/243 |
| 4,361,094 | 11/1982 | Schwarzkopf | 104/168 |
| 4,503,778 | 3/1985 | Wilson | 104/168 |
| 4,671,186 | 6/1987 | Kunczynski | 104/168 |
| 4,867,069 | 9/1989 | Kunczynski | 104/168 |
| 5,406,891 | 4/1995 | Kunczynski | 104/173.1 |
| 5,445,081 | 8/1995 | Kunczynski | 104/165 |
| 5,461,984 | 10/1995 | Andress III | 104/243 |

FOREIGN PATENT DOCUMENTS

| | | | |
|---|---|---|---|
| 2595310 | 9/1987 | France | 104/168 |

*Primary Examiner*—S. Joseph Morano

*Attorney, Agent, or Firm*—Flehr Hohbach Test Albritton & Herbert LLP

[57] ABSTRACT

A transportation system including a vehicle support structure (21), a vehicle (22) supported thereon, and elongated semi-rigid fin (44) attached to the vehicle (22) and a plurality of drive assemblies (45) positioned along the support structure (21) to frictionally engage and drive the fin (44). The fin (44) is sufficiently rigid for support of compressive loads, for example, in braking and acceleration, without lateral buckling, and moreover, the fin (44) is sufficiently rigid to assist in steering of the vehicle (22). The fin (44) preferably is not a continuous or endless member, but extends several vehicle lengths in front of the vehicle (22) for steering and most preferably several vehicle lengths behind the vehicle (22) for propulsion and braking. A flexible traction belt (86) optionally can be coupled in tandem with the fin (44) to provide an endless loop propulsion system. In the preferred form, the vehicle (21) is suspended by a pair of aligned, load-supporting wheels (36, 36*a*), and laterally extending outrigger roll control assemblies (40) are used to control roll of vehicle (22) about the load-supporting wheels (36, 36*a*). Methods for driving, steering and supporting the load of the vehicle (22) are also disclosed.

62 Claims, 11 Drawing Sheets

SEMI-RIGID, FIN-BASED TRANSPORTATION SYSTEM

TECHNICAL FIELD

The present invention relates, in general, to transportation or transit systems which employ a passive vehicle and an active guiding structure or track, and more particularly, relates to automated people-mover systems of the type which employ a traction element such as a haul rope or traction belt to propel the vehicle along the track.

BACKGROUND ART

For many years, haul rope-based transportation systems have been extensively used. Thus, ski lifts, chair lifts and aerial tramways have long employed a metal haul rope or cable to act as a traction element for a vehicle, which can take the form of a chair, gondola or tramway cabin. More recently, haul rope technology has been adapted to automated people mover systems, as for example is shown and described in my U.S. Pat. No. 5,406,891. Such systems employ a passive or unpowered vehicle which is supported by tires or sheaves on a guide track and propelled along the track over a transit path in either a loop or shuttle, by a haul rope. The haul rope is driven by bull wheels at end of the path and/or intermediate rope engaging drive wheels.

Haul rope-based people mover systems have numerous advantages, but they also pose certain problems, particularly in loop or curved track applications. Guiding of the haul rope under relatively high tension forces has attendant cost disadvantages, and driving of the haul rope intermediate ends of transit path is relatively difficult.

More recently, I have developed an automated people mover system which employs a flexible traction belt, instead of a haul rope. The use of a traction belt greatly simplifies the problems associated with driving the vehicle in a loop or along a curved track. Unlike haul ropes, a traction belt can be easily driven from locations intermediate the ends of the belt. Thus, a distributed drive system can be employed with a traction belt-based system, rather than drive assemblies positioned only at the ends of the transit path. As set forth in my U.S. Pat. No. 5,445,081, a plurality of belt-engaging drive wheels can be distributed along virtually any configuration of transit path so as to frictionally engage and propel the belt, and thus the vehicle.

The use of flexible conveyor-type belting as a tension or traction element in a transportation system also is described in U.S. Pat. No. 3,537,402 to Harkess. In the Harkess patent, the transportation system employs a flexible belt traction member which is not a continuous or endless belt. Instead, the Harkess traction belt extends in front of the vehicle only, with a locomotive coupled to the traction belt to maintain the belt taut so that friction drives distributed around the transit path can pull the vehicle, a loaded belt train. The locomotive constantly exerts a pulling or tension force on the traction belt in front of the vehicle, and the drive wheels in front of the vehicle also apply a tension force to the belt to propel the vehicle. Steering of the Harkess vehicle is accomplished by guide wheels which support the vehicle on the track or support structure.

It is also known in the prior art to drive transportation vehicles using relatively rigid shoes or drive fins that extend substantially over the length of the vehicle. U.S. Pat. No. 4,361,094 to Schwarzkopf, for example discloses such a system. The Schwarzkopf vehicle is guided or steered by rails and a longitudinally incompressible drive member or fin is driven between drive rollers or wheels. Similarly, U.S. Pat. No. 3,880,088 to Grant is typical of a transportation system in which frictional drive wheels are distributed along the track and engage a relatively rigid surface on the vehicle to propel the same.

While transportation systems which engage a fin or shoe over the length of the vehicle are capable of applying compressive loads along the track to both brake and propel the vehicle, these systems are limited as to the length over which both traction (tension) and compression forces may be applied. Moreover, steering or assisting in the steering of the vehicles in such prior art systems using the propulsion assemblies has not been attempted.

More generally, alternate automated people mover systems have included magnetic levitation systems, hover craft systems, and linear motor-based systems. The primary disadvantage of such systems is that of cost. The cost of the vehicle and the cost of the track on which it is transported are substantial. More particularly, the track construction is critical to proper operation of the vehicle. Track tolerances of one to two millimeters are common. This greatly increases construction costs and can pose serious problems in seismic areas or areas in which ground settling is difficult to prevent.

In long-haul transportation systems, the curves are usually relatively gradual and uncomfortable lateral accelerations, as a result of turning, are easily minimized. In people mover applications the transit path is typically shorter and turns typically have tighter radii than in long-haul transit systems, e.g. 40 feet or less. One problem which is common to virtually all automated people mover systems, therefore, is the problem of lateral guiding or steering of the vehicle without uncomfortable lateral accelerations. Most typically people mover steering is accomplished by flanged load-supporting wheels or lateral guide wheels which engage a guiding surface of the support structure. The natural tendency of a set of wheels, or bogey, is to try to maintain the vehicle in a straight path. On turns, therefore, the vehicle wheels tend to fight the turn as they hunt for or oscillate around, a nominal turn path. The attendant lateral accelerations can be unpleasant to riders.

Another problem encountered in turning is that the trackway must be sloped (super elevated) in order to tilt the vehicle into the turn to offset the centrifugal force around the turn and is required by most codes if the centrifugal acceleration is 0.10 g or more. Vehicle tilting gives the riders a comfortable ride around the turn. The cost of building a trackway having tilted turns, which are often compounded by being on a grade, can be very substantial, particularly if all of the dimensions must be held within a few millimeters.

Still a further problem which has been encountered with automated people mover systems of the traction-type is braking. Flexible belts, for example, of the type in my U.S. Pat. No. 5,445,081 and in Harkess U.S. Pat. No. 3,537,402, are well suited for propulsion using friction drives because the belt will withstand substantial tension forces. Braking, however, is another problem because the inherent flexibility of the belt will not withstand compression loading without buckling. Accordingly, the belt must either be braked from behind the vehicle, which is not possible with Harkess because there is no belt behind the vehicle, or auxiliary braking must be provided, for example, by frictional braking against a shoe or surface on the vehicle or by braking of the wheels of the vehicle.

Accordingly, it is an object of the present invention to provide a transportation system suitable for use as a short-haul people mover which has greatly improved propulsion system and steering control and has a greatly reduced cost of construction of the track or support structure.

Another object of the present invention is to provide a transportation system suitable for use as an automated people mover in which the track is active, the vehicle is passive and vehicle steering can be accomplished in part by using the vehicle propulsion system.

Still a further object of the present invention is to provide a vehicle propulsion system for an automated people mover which will allow multiple vehicles to be independently run on the support track while still affording independent braking and acceleration control of each vehicle.

Still another object of the present invention is to provide a transportation system which is durable, relatively low in cost to construct, inexpensive to maintain, adaptable to a wide range of applications, less sensitive to ground settling, and more comfortable for passengers.

The transportation system of the present invention has other objects and features of advantage which will become more apparent from, and are set forth in more detail in, the accompanying drawing and the following description of the Best Mode of Carrying Out the Invention.

DISCLOSURE OF INVENTION

The transportation system of the present invention comprises, briefly, a vehicle support structure or track which extends along a transit structure; a vehicle supported on the support structure for movement along the structure; and an elongated, semi-rigid fin attached to the vehicle for transmission of propulsion forces along the path to the vehicle. The semi-rigid fin has a length along the path greater than the vehicle length and less than the length of the path, and a plurality of drive assemblies are positioned along the support structure to frictionally engage and drive the fin, applying both tension and compression forces to the fin. In addition to acting as a traction element in advance of the vehicle, the fin is sufficiently rigid to withstand significant compressive loading forces without lateral buckling of the fin in order to allow both braking in front of the vehicle and driving from behind the vehicle.

In another aspect of the present invention, the fin also has sufficient lateral rigidity to enable steering of the vehicle on the support structure at least in part by using the fin. A plurality of fin guiding assemblies are positioned along the support structure to frictionally engage the semi-rigid fin and laterally position the fin relative to the support structure. The semi-rigid fin, in turn, is coupled to the vehicle through a propulsion and steering assembly to effect, in part, steering of the vehicle on the support structure. The frictional drive assemblies can be used, in part or entirely, to effect fin guiding, but in track sections in which the drive assemblies are separated by a substantial distance intermediate fin guide assemblies are employed.

Since the semi-rigid drive and steering fin extend in front of the vehicle by a substantial distance, for example, 2–4 vehicle lengths, the semi-rigid nature of the fin causes the fin to bend laterally through a relatively smooth arc on turns. This gradual, smooth bending, can be combined with track-engaging guide wheels to reduce uncomfortable vehicle lateral acceleration.

In still a further aspect of the present invention, the transportation vehicle is formed with a pair of load-supporting wheels mounted for rotation to the vehicle body in a longitudinally spaced and substantially axially aligned relationship, and at least one outrigger or roll control assembly is mounted to the vehicle body and extends laterally from the load-supporting wheels to engage a guide surface and maintain the vehicle in a stable roll orientation.

The method of the present invention is comprised, briefly, of the steps of supporting an elongated, semi-rigid fin from the vehicle, most preferably in a generally vertical orientation, with the fin having a length dimension substantially greater than the length of the vehicle. The fin extends forwardly of the vehicle, and preferably rearwardly, by at least one vehicle length dimension, and the fin is formed as a semi-rigid member which is secured to the vehicle for the transmission of both driving and lateral steering forces from the fin to the vehicle.

In one aspect of the method, the step of applying both tension and compression forces to the fin through drive assemblies frictionally engaging the fin is taken to propel and brake the vehicle without fin buckling.

Another aspect of the method, the step of engaging the fin on a side thereof by fin positioning assemblies is taken with the positioning assemblies being formed to guide the lateral position of the fin relative to the track as the vehicle and fin are propelled along the track to assist in steering of the vehicle along the track.

In a final aspect of the method of the present invention, a method of supporting a transportation vehicle is provided comprising the steps of supporting the majority of the weight of the vehicle on a pair of longitudinally spaced and substantially aligned, load-supporting wheels, and controlling roll orientation of the vehicle about the load-supporting wheels by a roll control assembly.

BEST MODE OF CARRYING OUT THE INVENTION

The transportation system of the present invention employs a passive or unpowered vehicle and an active or powered track for the vehicle. Instead of employing an endless loop traction belt, however, the transportation of the present invention is based upon the use of a semi-rigid fin which is attached to the vehicle and driven by frictional drive assemblies distributed along a vehicle support structure or track. In one aspect of the present invention, the semi-rigid fin provides a structure which can both drive and brake the vehicle using compressive loading along the length of the semi-rigid fin without fin buckling. In another aspect of the present invention, the semi-rigid fin is used to assist in steering of the vehicle in a manner which reduces uncomfortable lateral acceleration forces. In the most preferred form, the semi-rigid fin is employed for both driving and steering of the vehicle.

The semi-rigid fin of the transportation system of the present invention has a length which is longer than the vehicle but substantially less than the entire transit path. The fin length, combined with its rigidity, enhances both propulsion and steering of the vehicle. The semi rigid fin, however, does not have to be formed as a continuous or endless member. Instead, the semi-rigid fin is finite in length, with the length preferably several times the length of the vehicle. The finite length of the fin allows a plurality of vehicles to be independently moved on the track. Alternatively, however, a flexible traction belt can be coupled in tandem with the semi-rigid fin to provide an endless loop drive assembly.

In another aspect of the present invention, the vehicle is provided with a two-wheel load-supporting suspension having an outrigger or roll-control assembly which causes the vehicle to be stable about the roll axis and yet to have some of the operating advantages of a bicycle. This suspension also allows cost reductions in construction of the vehicle supporting track.

Figure 1:
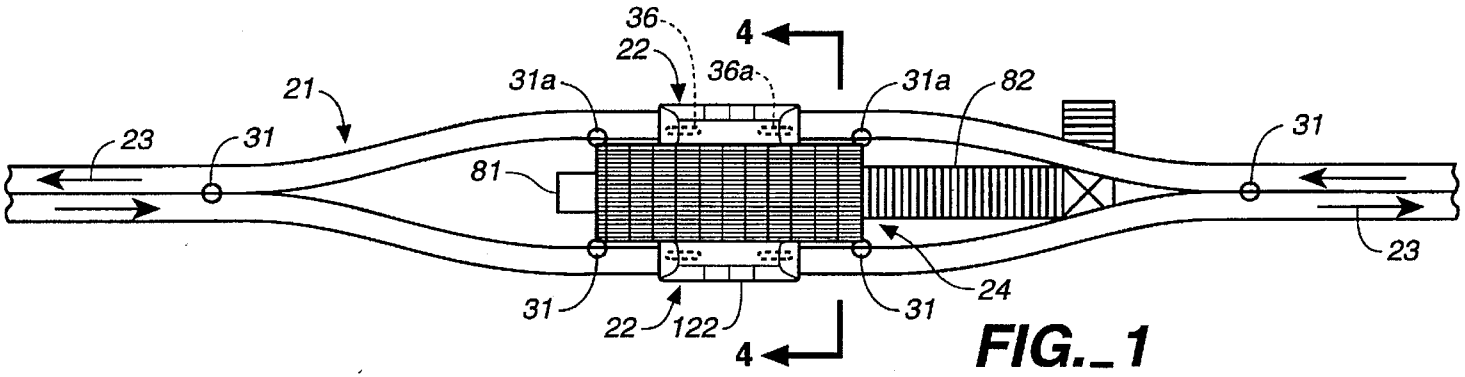
FIG. 1 is a top plan, schematic view of a middle section of track and an intermediate station in a transportation system constructed in accordance with the present invention.
Figure 2:
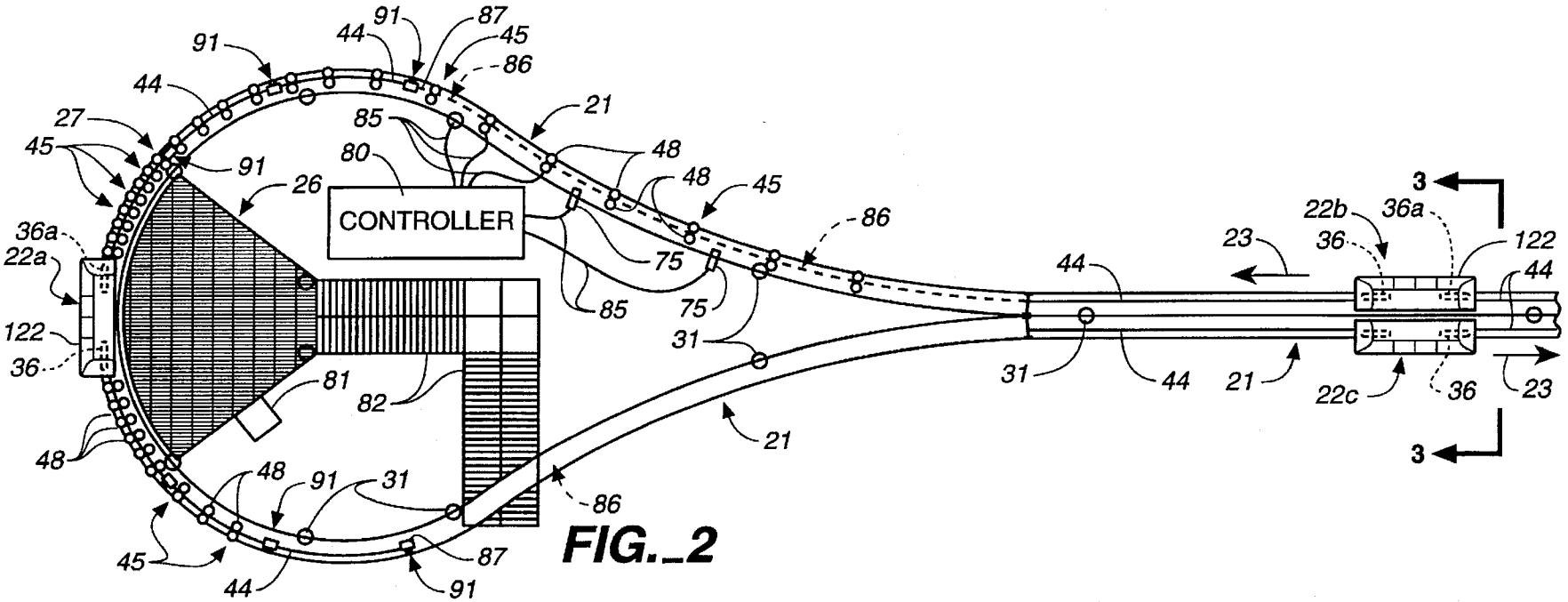
FIG. 2 is a top plan, schematic view of an end section of track and an end station constructed in accordance with the present invention.
Figure 3:
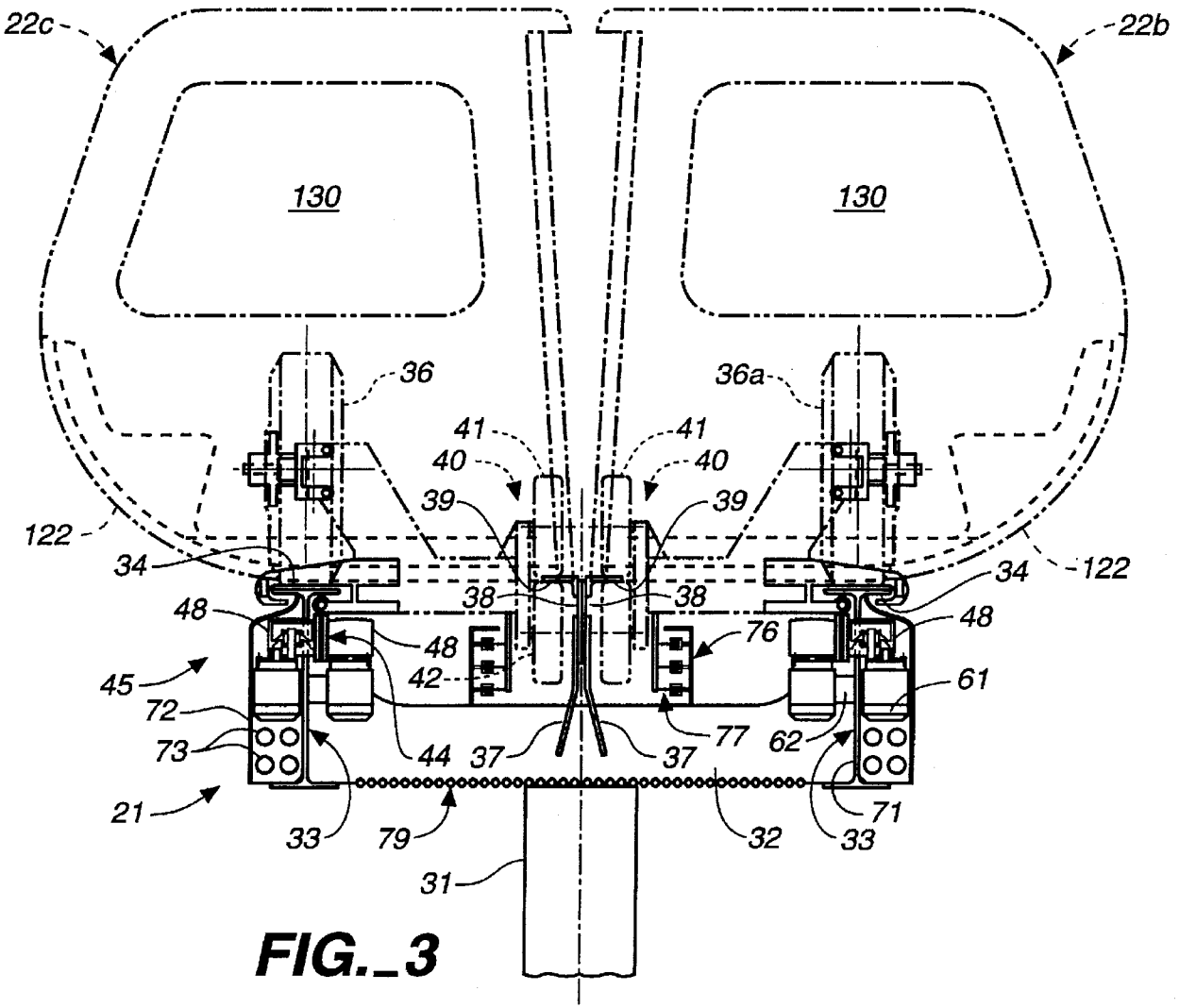
FIG. 3 is an enlarged, end elevation view, in cross section, taken substantially along the plane of line 3—3 in FIG. 2, showing the track, with the transportation vehicles shown in phantom.

Referring now to the drawing, and particularly FIGS. 1–3, a transportation system is shown in which there is a vehicle support structure, generally designated 21, which in the preferred form is not a pair of conventional rails, but also is referred to herein as a "track." Support structure 21 extends along a transit path, and in automated people mover systems, this path will typically be relatively short, for example 1,000 feet to three miles. It will be understood, however, that the length of vehicle support structure 21 can be many miles, without departing from the spirit and scope of the present invention.

Figure 5:
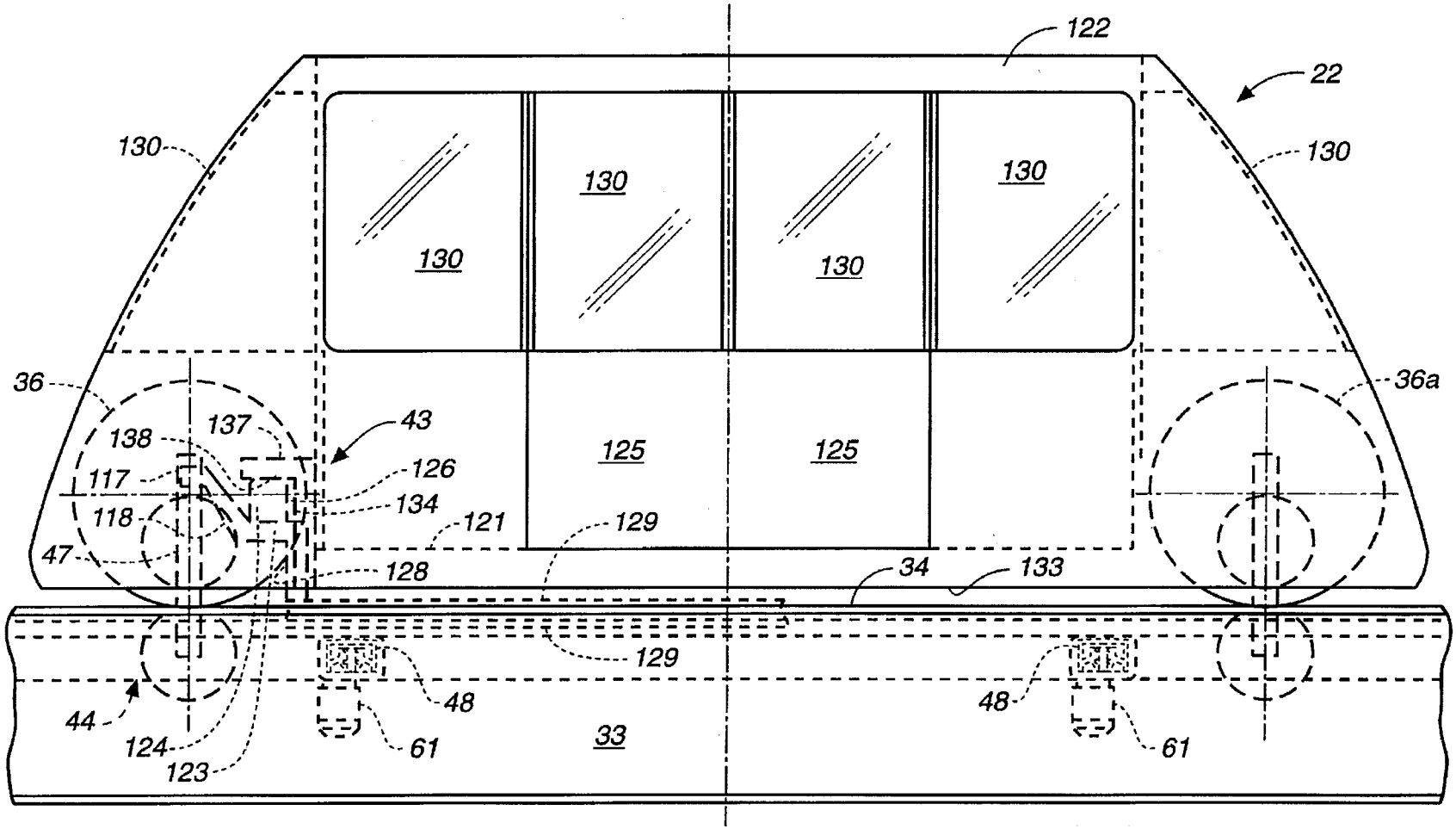
FIG. 5 is a side elevation view of a transportation vehicle constructed in accordance with the present invention and supported on the track of FIGS. 3 and 4.

Mounted on support structure 21 is at least one vehicle, generally designated 22, and in most systems there will be a plurality of transportation vehicles 22, such as vehicles 22*a*, 22*b* and 22*c* in FIG. 2, movably supported on track 21 for propulsion along the transit path. As shown in FIGS. 1 and 2, the vehicles 22 are advancing in the direction of arrows 23 along track 21, which tends to be constructed so that the vehicles can pass each other while travelling in opposite directions in a close, side-by-side relation over most of the track's length. Vehicles 22 can carry passengers or payloads, but in most applications vehicles 22 will have cabins 122 which accommodate passengers, and movable door assemblies 125 with cabin windows 130, as best seen in FIG. 5. Movable doors 125 can be provided in one or both sides of vehicle 22, depending on the station location along track 21. Accordingly, as will be seen in FIG. 1, a passenger loading and unloading station 24 is positioned between tracks running in opposite directions in a location intermediate the ends of the support structure. Thus, doors 125 would be provided on the inside side of vehicles 22. In FIG. 2, an end station 26 is shown positioned inside an end loop 27 of vehicle support structure 21, and doors 125 again would be on the inside of the vehicle. If a station was placed on the outside of loop 27, doors 125 would be on the outside of the vehicle.

As can be seen by comparison of FIGS. 1 and 2 with FIG. 3, track assembly 21 is merely schematically shown in FIGS. 1 and 2. One of the important features of the transportation system of the present invention, however, is that vehicles 22 are constructed and are supported for movement in a manner which allows track 21 to be extremely compact in its width dimension so as to have a minimum "foot print" on the ground and a minimum "sky print" overhead. This compactness can best be seen in FIG. 3, which shows the track as it typically will appear over the vast majority of the transit path.

In FIG. 3, vehicle support structure 21 can be seen to be supported on spaced apart, vertically-extending towers or post members 31 having a transversely mounted cross arm 32 carried by an upper end thereof. The opposite ends of cross arm 32 have longitudinally extending I-beams 33 mounted thereto, which I-beams have upwardly facing and longitudinally extending flanges 34 that provide the longitudinal support surface for vehicles 22*b* and 22*c*. As will be seen from FIG. 3, each of vehicles 22*b* and 22*c* includes a load-supporting wheel 36 which engages and is supported on flange 34 of vehicle support structure 21, and as can be seen from FIG. 2, a second, load-supporting or rear wheel 36*a* also is supported on flange 34. Wheels 36 and 36*a* are preferably substantially longitudinally aligned to minimize the width requirement of track 21, but they do not have to be in the same plane.

While one of the important advantages of the transportation system guideway or track 21 is that it is compact and can be supported in an elevated position for movement of vehicles in opposite directions by a single tower or post member 31, it also will be appreciated that post 31 can be eliminated and track 21 can be supported at grade or in a tunnel.

As also may be seen from FIG. 3, proximate the center of cross arm 32 two vertically extending arms 37 are rigidly secured to the cross arm. Vertical extension members 38 similarly are secured to arms 37, and longitudinally extending L-shaped guide flanges 39 are mounted to the extension members. As will be seen, a roll control assembly, generally designated 40, and including a first guide wheel 41 and a second guide wheel 42 roll on the upwardly and downwardly facing surfaces of guide flanges 39. Assembly 40 acts as an outrigger assembly or roll control device, which enables vehicles 22*b* and 22*c* to be supported on only a pair of longitudinally aligned wheels 36 and 36*a*, as will be described in more detail below.

Figure 7:
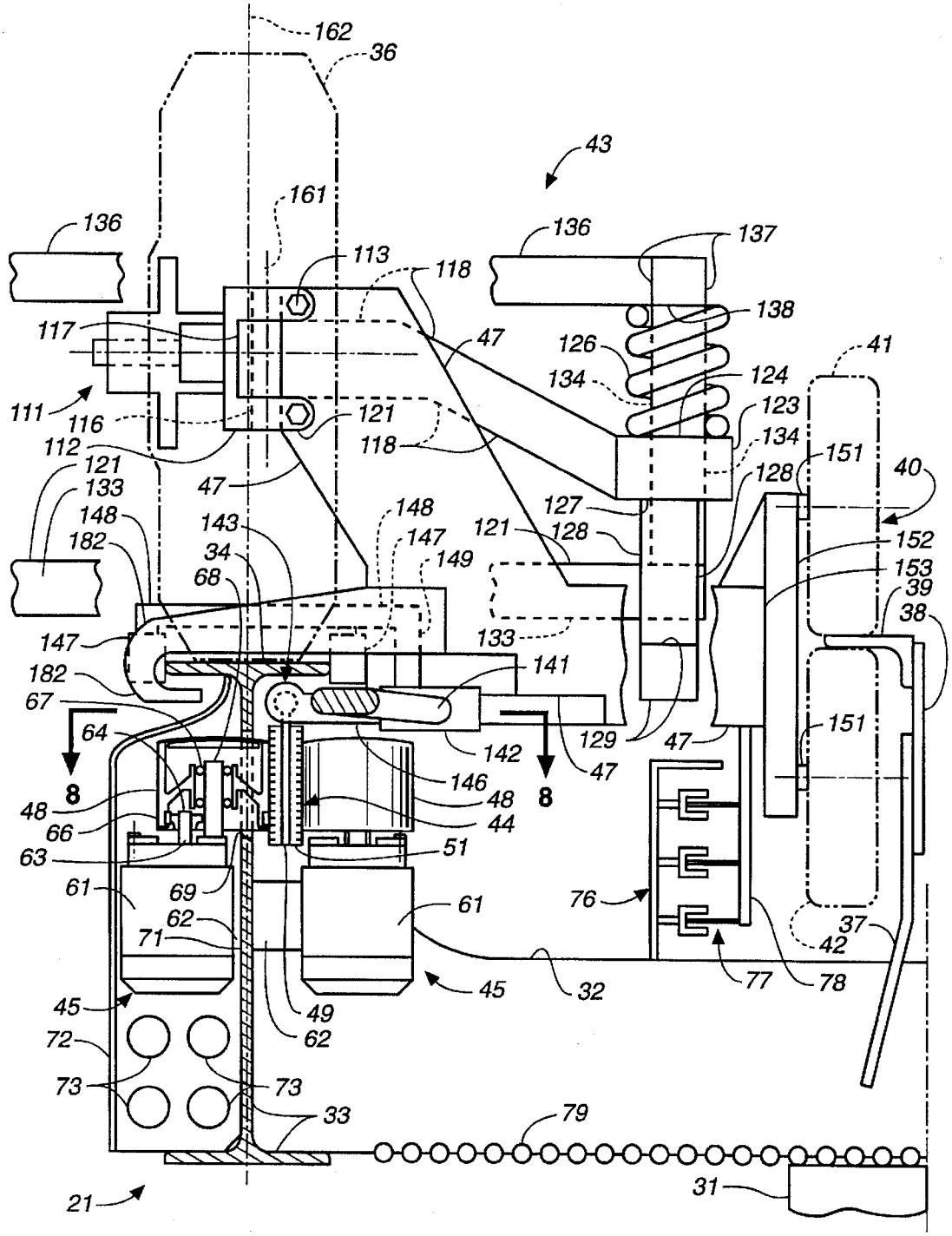
FIG. 7 is a further enlarged, end elevation view showing details of the track-mounted vehicle drive assembly, the semi-rigid drive and steering fin and the vehicle steering and suspension assembly.

Referring now to FIG. 7, further details of the construction of track 21 and the vehicle drive, steering and suspension assembly can be described. Attached to a undercarriage assembly, generally designated 43, is an elongated, semi-rigid fin, generally designated 44. Fin 44 is coupled by a ball joint 143 to horizontally extending arm 146. Arm 146, in turn, is secured to transverse outrigger arm 47 that is coupled to king pin 116, and accordingly the framework or the chassis of the vehicle. Frictional driving forces in a direction along track 21 are applied to fin 44 by drive assemblies 45, and the driving forces are transmitted from semi-rigid fin 44 to arm 146 and transverse outrigger arm 47 through king pin 116 to framework 133 to drive vehicle 22 along support structure 21, as will be described in more detail below.

In the transportation system of the present invention, however, fin 44 is not merely a flexible traction belt capable of supporting only tension forces. Instead, fin 44 is a semi-rigid fin having sufficient rigidity for both braking and propulsion of vehicle 22 using compression loading along the length dimension of the fin without longitudinal collapse or buckling of the fin. Thus, prior art traction belts typically have been quite flexible and incapable of compressive loading for either braking or propelling of vehicles. Applying a compressive force along the length of such traction belts will immediately cause the belt to buckle longitudinally along the track, which, of course, is unacceptable.

Figure 8:
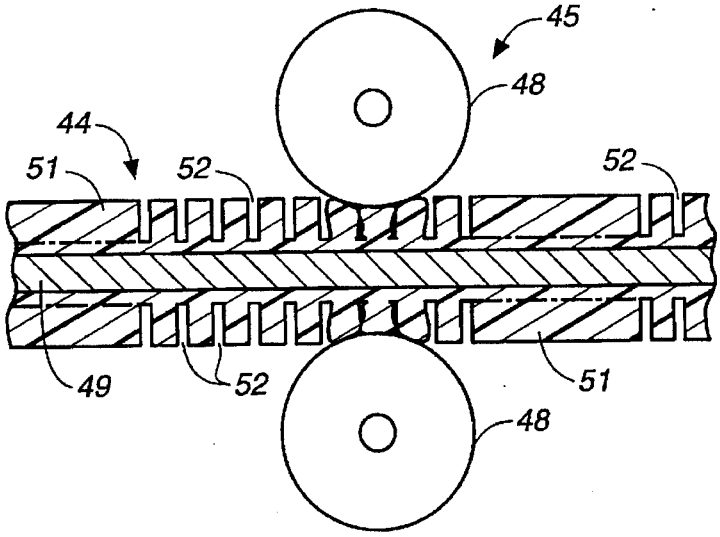
FIG. 8 is a fragmentary, top plan schematic view of the drive assembly and semi-rigid drive and steering fin.

Referring now to FIGS. 7 and 8, the preferred form of semi-rigid fin 44 can be seen to include an elongated, relatively rigid plate 49. Plate 49 can be provided by spring steel, aluminum, pulltruded, fiber-reinforced plastics, or similar plate material which can withstand significant compressive loading along its length without buckling. Opposite sides of plate 49 are preferably covered by a layer of resilient natural or synthetic rubber 51. As will be explained below, rubber layers 51 advantageously can be grooved or slotted at 52 to make them resiliently compressible between opposed drive wheels 48 of drive assemblies 45, and layers 51 may be bonded adhesively or through vulcanization to plate 49.

Figure 8A:
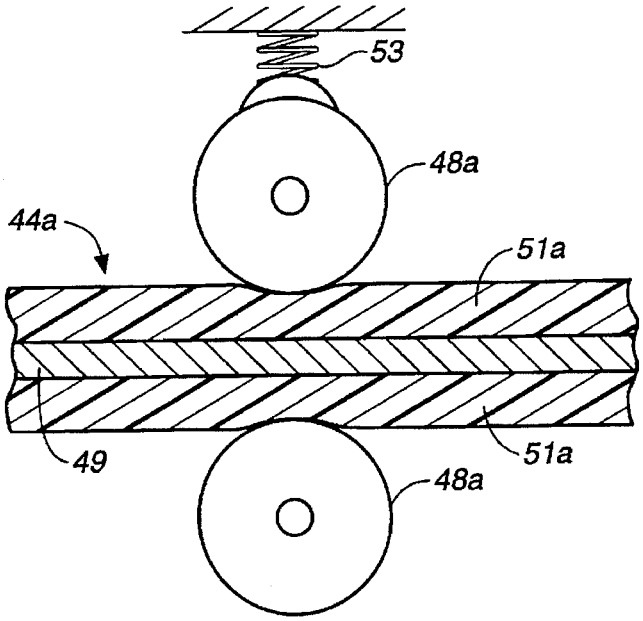
FIG. 8A is a fragmentary, top plan schematic view corresponding to FIG. 8 of an alternative semi-rigid drive and steering fin construction.

As shown in FIG. 8A, however, an alternative embodiment of semi-rigid fin 44 employs rubber layers 51*a* bonded to steel plate 49*a*, which layers are unslotted. The purpose of slots 52 in FIG. 8 is not to provide flexibility in fin 44, but instead is to provide resilient compressibility in the thickness dimension in order to allow opposed drive wheels 48 to be mounted at fixed centers. The frictional driving of fin 44 is ensured by mounting wheels 48 for interference engagement and resilient compression of the grooved layers 51. In FIG. 8A, at least one of drive wheels 48*a* is resiliently biased, for example by a biasing spring 53, toward fin 44*a* to ensure sufficient frictional engagement of fin 44*a* by opposed drive wheels 48*a*.

Figure 8B:
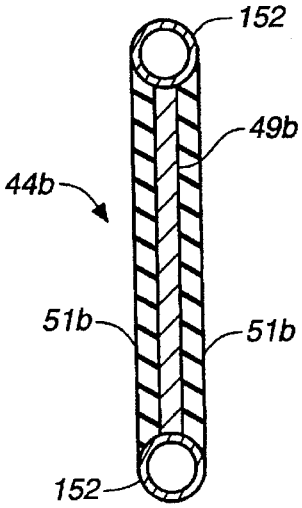
FIG. 8B is an end elevation view, in cross section, of a further alternative embodiment of a semi-rigid fin constructed in accordance with the present invention.

In still a further alternative embodiment of the semi-rigid fin of the present invention weight savings is accomplished as shown in FIG. 8B. Semi-rigid fin 44*b* is constructed from a relatively rigid plate 49*b* which has tubular strengthening members 152 secured along upper and lower plate edges. Bonded to opposed sides of plate 49*b* are rubber layers 51*b*, which here are shown to be unslotted. The fin construction of FIG. 8B achieves the desired rigidity while allowing plate 49*b* to be thinner and thus lighter in weight.

In the preferred form of semi-rigid fin 44, plate member 49 will have a thickness dimension in the range of about one-quarter to about one inch, depending upon the material used. For fins constructed as shown in FIG. 8B, even thinner plates 49*b* are believed to be possible. The height dimension of the plate will range from about six inches to about 12 inches, and an upper edge 54 of plate 49 can be mounted by ball joint 143 to arm 146. Each rubber layer 51 will typically have a thickness dimension in the range of about one-quarter to about one-half inch and will cover most of both sides of fin plate 49.

As will be understood, semi-rigid fin 44 also has some degree of lateral flexibility, that is, it must be capable of lateral bending around the smallest radius along the transit path. As shown in FIG. 2, the smallest radius often will be in end loop section 27 of the support structure, although it will be understood that the minimum track radius may occur at other locations. While a steel plate, or similar rigid fin assembly, which is one-quarter to one inch in thickness is very difficult to bend over a short length, as the length of the plate is increased, lateral deflection or bending becomes easier. In the present invention, elongated semi-rigid fin 44 has a length along the transit path or track 21 which is substantially greater than the length of the vehicle, and yet is less than the length of the entire track. This fin length, therefore, allows the semi-rigid fin to be laterally displaced or bent as it travels along the track.

As used herein, the expressions "length of the vehicle" and "vehicle length" shall mean the length along track 21 of a steerable unit of the overall assembly being propelled along the track. As illustrated in FIGS. 1 and 2, vehicle 21 is shown as a single steerable unit, but it will be understood that two or more such units could be coupled together in tandem to form a train.

Most typically, the length of fin 44 will be four to six times the length of the vehicle, and in most cases less than 10 times the length of the vehicle. If a steerable transit vehicle unit 22 typically has a length in the range of 20 to 40 feet, semi-rigid fin 44 will have a length in the range of about 80 to about 400 feet. In the form of transportation system illustrated in the drawing, the preferred length of vehicle 22 is about 20 feet from front wheel 36 to rear wheel 36*a*, while the length of semi-rigid fin 44 is about 122 feet, or slightly more than six times the length of the vehicle.

A steel plate, even with rubber layers on both sides, which is 122 feet long can be readily laterally deflected about a radius which is, for example, about 40 feet, as shown in end loop section 27 of FIG. 2. The semi-rigid fin will extend by approximately two and one-half vehicle lengths in front of, and two and one-half vehicle lengths in back of, vehicle 22, making its bending or deflection around a turn having a 40 foot radius relatively easy.

Over a short distance, however, drive fin 44 is quite capable of supporting both tension and compression driving forces from drive assemblies 45. Thus, as the semi-rigid fin 44 passes between pairs of drive wheels 48, the drive wheels can apply a tension or traction force in front of the vehicle to pull vehicle 22 along track 21 in a conventional manner. Additionally, however, drive assemblies 45 also can apply compression forces along fin 44 behind the vehicle to drive the vehicle along the track. Similarly, in braking a compression force can be applied in front of the vehicle without lateral buckling of semi-rigid fin 44. The semi-rigid nature of drive fin 44, plus its length, enables drive assemblies 45 to apply compressive loads for both propulsion and braking over a substantial length of the fin. Thus, many drive assemblies may be used in traction and compression to accelerate and decelerate vehicles 22 and yet the vehicles do not have to be attached to a single endless belt or haul rope. Semi-rigid fin 44 therefore, eliminates the need to brake vehicle wheels 36, 36*a* or use track-mounted auxiliary braking assemblies, and allows both tension and compression loading along the fin to effect propulsion.

Buckling of fin 49 is prevented by the semi-rigid nature of the fin and its support by drive assemblies 45 and fin guiding assemblies, and yet the fin can be driven around curves which are fairly small in radius due to the length of the fin. Moreover, the rigidity of fin 44, together with its length substantially in excess of the vehicle length, give the present transportation system greatly improved driving and braking capabilities which will accommodate a wider range of loads and velocity profiles as compared to prior art systems.

As above noted, drive assemblies 45 provide lateral support for fin 44, which support along the length of fin 44 combines with fin rigidity to prevent buckling. As will be described in more detail hereinafter, auxiliary fin guiding assemblies also may be provided intermediate drive assemblies 45 to further ensure that the semi-rigid fin is supported laterally against buckling. Such fin guiding assemblies also provide the dual function of guiding or steering the fin so as to ensure its precise lateral position as the fin and vehicle are propelled around support structure 21. As set forth hereinafter, this guiding function is also an important aspect of the present invention and is used in part to effect lateral steering of vehicles 22.

Before describing the steering function of the present invention, further detail as to the supporting track and drive assemblies 45 will be described. Referring again to FIG. 7, longitudinally extending I-beams 33 on each end of cross arm 32 have drive motors 61 mounted thereto by brackets 62. In the preferred form, the motor output shaft 63 has a pinion gear 64 mounted thereon which drives a ring gear 66 mounted on the inside of frictional drive wheel 48. Drive wheel 48 is mounted by bearings 67 to a support shaft 68. As will be seen from FIG. 7, fin 44 is mounted on one side of the I-beam central flange 71 so that one drive wheel must extend through an opening 69 in central flange 71 of I-beam 33 in order to engage fin 44. The provision of openings periodically along the central flange 71 will not materially affect the overall I-beam strength. Motor 61 typically will be on the order of a one to four horsepower electrical gear motor, and in the most preferred form two horsepower motors are employed. As will be understood, drive assemblies 45 also could be comprised of a drive and an opposed idler wheel instead of two driven wheels or rollers.

Mounted underneath protective shell or housing 72 are conduits 73 for motor controls, communications and electrical power. In the preferred form of the transportation system of the present invention, motors 61 are operated substantially only when fin 44 of a vehicle passes between, or is closely approaching, a drive assembly 45. Thus, as seen in FIG. 2, the vehicle support structure or track 21 preferably includes fin or vehicle sensing devices, such as optical or magnetic sensors 75, which can sense the position of the fin or vehicle along track 21. Sensors 75 and drive assemblies 45 can be coupled to central controller 80 by conductor lines 85 in conduits 73 and can be activated in advance of the fin from central control computer 80. Operation of drive assemblies 45 can be terminated by the controller as the fin passes beyond a particular set of drive wheels. During passage of the fin between drive wheels, computer 80 would also cause the drive wheels to accelerate or decelerate the fin and vehicle, in accordance with the desired velocity profile along track 21.

Power to the vehicle for lighting, HVAC and audio communications can be provided by a power rail assembly 76 carried on cross arm 32 and slidably receiving a brush assembly 77 mounted from downwardly depending arm 78 from a portion of the vehicle, for example, arm 47.

In order to provide for maintenance of the track 21 and further to provide an emergency walkway for passengers, a longitudinally extending grating assembly 79 can be provided along an edge of cross arms 32. The grating assembly will extend along the track so that passengers can walk on the same over lengths between towers 31 to emergency exit ladders (not shown) carried by the towers.

Figure 4:
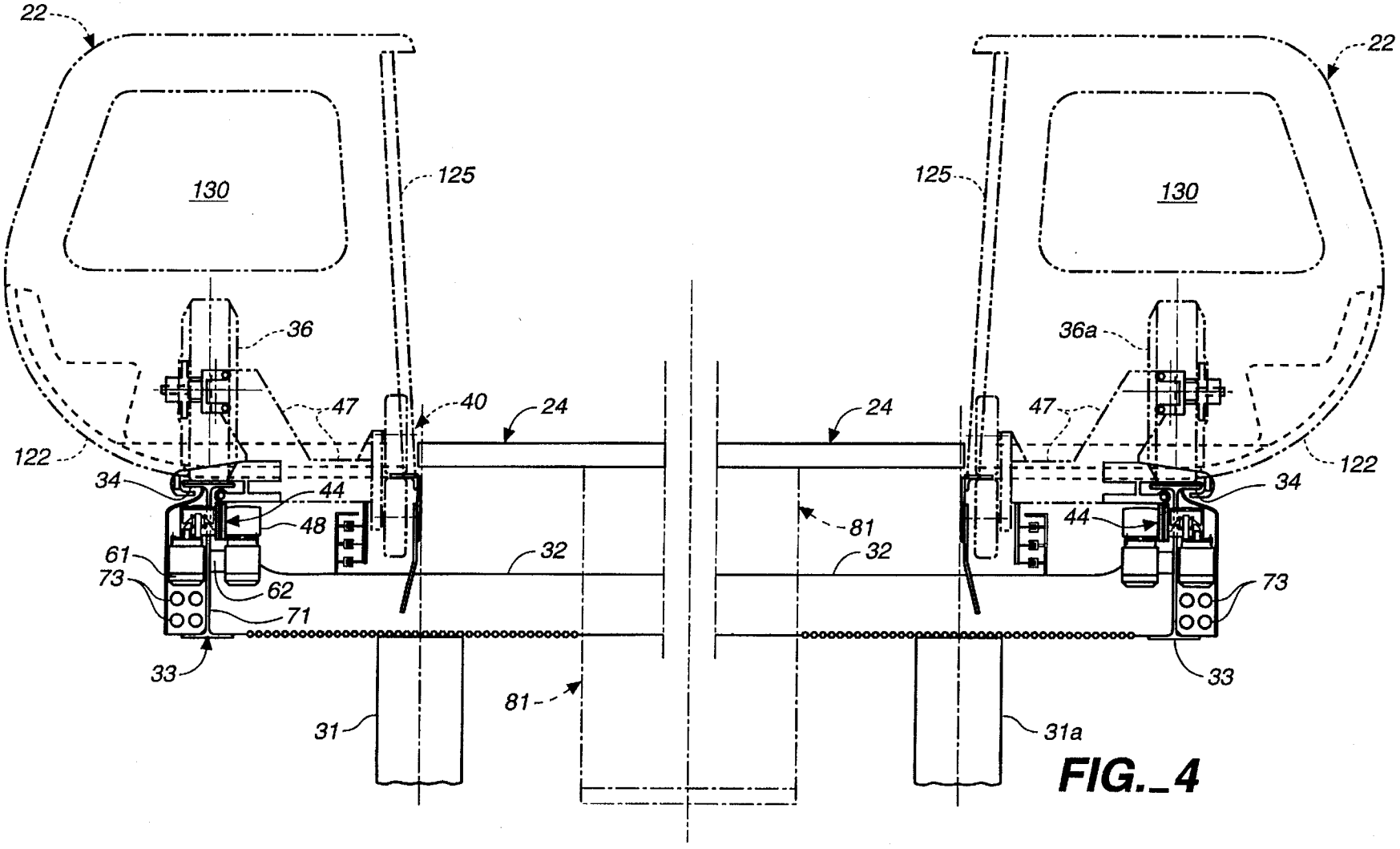
FIG. 4 is an enlarged, end elevation view, taken substantially along the plane of line 4—4 in FIG. 1, showing the intermediate station and track, with the transportation vehicles shown in phantom.

Referring now to FIG. 4, the only difference in the track construction as compared to FIG. 3 is that the I-beams 33 on which vehicles 22 are supported have been separated. As shown in FIG. 1, this separation will allow a platform 24 to be positioned between vehicles 22 for loading and unloading of the vehicles on opposite sides of a single platform 24. A single cross arm 32 can be supported from a pair of vertical towers or posts 31 and 31*a*, and an elevator 81 can be positioned to service platform 24, as well as stairway 82. In locations where snow can be expected, it is advantageous to form the platform 24 as an opening grating-type platform, but it will be understood that roofs and enclosures can also be provided at platforms 24 and 26.

Continuing with the driving function of the transportation system of the present invention, it will be appreciated that while a semi-rigid fin is required for compressive loading to either assist in the braking or driving of the vehicles, there will be sections of the transit path which essentially require only that the vehicle velocity be maintained substantially constant. As can be seen in FIG. 2, therefore, once the constant velocity has been reached, the distance between drive assemblies 45 increases, and the number of drive assemblies per unit length of track 21 decreases.

In one aspect of the present invention, it is desirable to be able to have independent vehicles so that one vehicle may be moving while the other is stopped. The use of a drive fin approach to propulsion allows, for example, vehicle 22*a* to be stopped at station 26, while vehicle 22*b* is moving at one velocity and vehicle 22*c* is moving at another velocity. Such independent operation is controlled by computer 80 and vehicle/fin sensors 75 along the track or support structure 21.

Figure 10:
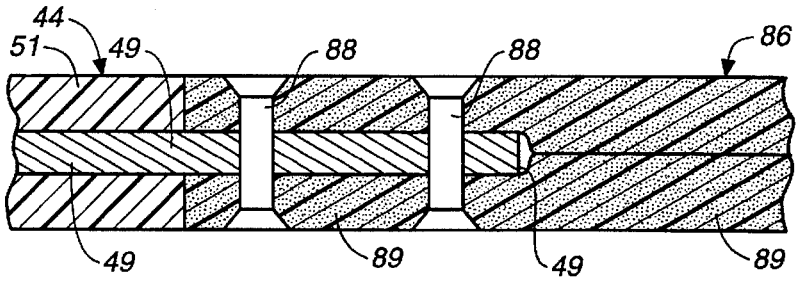
FIG. 10 is a fragmentary, enlarged top plan view, in cross-section, of the drive and steering fin of the present invention as joined to a traction belt and taken substantially along the plane of line 10—10 in FIG. 11.
Figure 11:
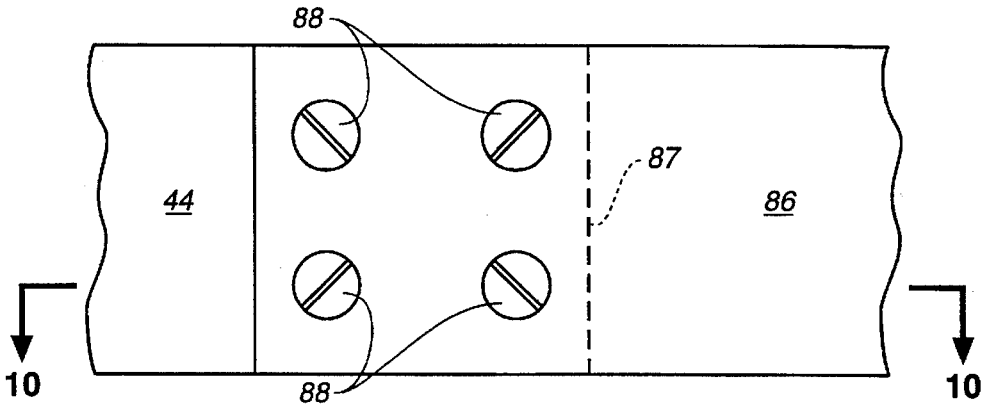
FIG. 11 is a side elevation view of the drive and steering fin and traction belt shown in FIG. 10.

In another aspect of the present invention, however, a continuous drive assembly is provided along trackway 21, with all the vehicles 22 moving at substantially the same speed and stopping at the same time. In such a system, semi-rigid fin 44 is coupled to a flexible traction belt 86, as best may be seen in FIGS. 10 and 11 and as is schematically represented in FIG. 2 by dotted lines 86. Thus, a semi-rigid drive fin 44 has coupled to the forward and rearward ends 87 a flexible traction belt 86. Such coupling can be accomplished by fasteners 88 which pass through body 89 of the traction belt and an end section of the steel plate 49 of drive fin 44.

FIG. 2 illustrates a continuous loop configuration in which sections of flexible traction belting 86 extend between sequential vehicle drive fins 44. The most advantageous application for the use of a drive fin 44 and a traction belt 86 in tandem is in a shuttle application. This would allow flexible belt 86 to be turned around at a bull wheel of very small diameter, e.g., 10 to 50 inches, and drive fins 44 would not need to be flexible enough to bend around this small radius.

The tandem fin/belt approach allows computer controller 80 to apply compressive loading only to drive fin 44. One area might be in the zone ahead of vehicles 22, as they enter stations 24 and 26, to decelerate the vehicle and stop the same at the station. On stretches of the transit path in which vehicles 22 are travelling at a substantially constant speed, however, and in areas of acceleration, controller 80 can cause drive assemblies 45 to apply a traction or tension force to both fin 44 and flexible traction belt 86. The tandem coupling of the traction belt to semi-rigid fin 44, therefore, allows augmentation of the drive force which may be applied along the belt-fin tandem assembly by tension forces applied to belt 86, as well as enabling small radius turnarounds.

As will be appreciated, even semi-rigid fins will need to be supported remotely of vehicle 22 if their length is several times that of the vehicle. In the preferred form, moving support of the elongated semi-rigid fin 44 is accomplished by employing one or more trolley assemblies, generally designated 91 and best seen in FIG. 9. Trolley assembly 91 can include a main load-supporting wheel 92 which rides upper flange 34 of I-beam 33 and opposed lateral guide wheels 93 and 94 (shown in broken lines), which guide wheels ride opposite edges of flange 34. Depending downwardly from wheel 94 is a U-shaped arm 96 which extends around guide wheel 94 and back into semi-rigid fin 44. Fin 44 may be secured, for example, by welding or bolting to arm 96. Thus, fin 44 is supported from trolley 91 beneath upper flange 34 of I-beam 33 so that the weight of the semi-rigid fin does not have to be cantilevered from, nor will it downwardly deflect with respect to, the vehicle. Trolley assemblies 91 can be positioned periodically along the length of the semi-rigid fin, as best may be seen in FIG. 2. Many other forms of fin-supporting trolleys are suitable for use in the transportation system of the present invention.

As will be appreciated guide wheels 93 and 94 on trolley 91 not only guide the trolley, but they also laterally position fin 44 relative to flange 34 of the I-beam. While it would be possible to guide the lateral position of drive fin 44 solely using trolley assemblies 91, it is preferred to guide the lateral position of fin 44 in part by using a combination of trolleys 91, drive assemblies 45 and track-mounted fin guiding assemblies, generally designated 98.

Figure 9:
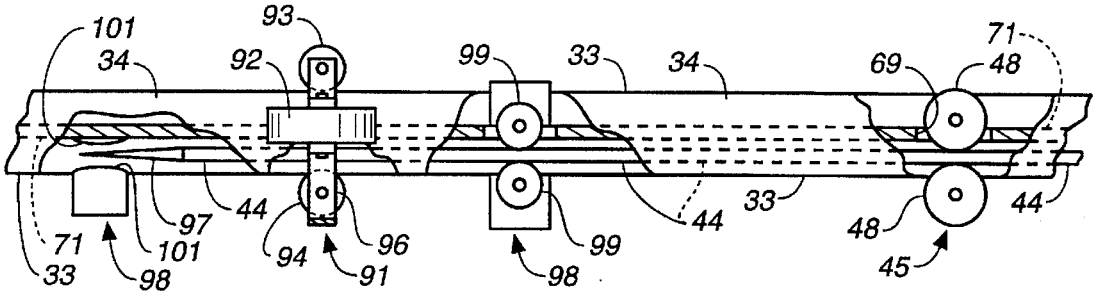
FIG. 9 is a fragmentary, top plan view of section of track, partially broken away, showing a rolling fin support trolley constructed in accordance with the present invention.

As shown in FIG. 9, three types of fin guide assemblies are employed in addition to trolleys 91. First, drive assemblies 45 also function as fin guide assemblies. Moreover, on the right side of trolley assembly 91 are a pair of unpowered roller guide wheels 99, while on the left side of trolley assembly 91 are a pair of sliding guide surfaces 101. The precise lateral location of fin 44 relative to flange surface 34, therefore, can be controlled by the drive assemblies, roller guides or sliding guides. Thus, the mounting brackets for drive wheels 48, for guide rollers 99 and for guide surfaces 101 can all be adjusted so that semi-rigid fin 44 will be precisely located relative to flange 34. Tapered nose portion 97 of fin 44 facilitates entry of drive fin 44 between the drive assembly wheels 48, as well as guide rollers 99 and guide surfaces 101. Obviously, it is preferable that guide surfaces 101 and fin nose 97 be low-friction surfaces, such as Teflon or the like, and it is also possible to use longitudinally extending guiding bars (not shown) that extend the full length between adjacent drive assemblies 45.

Since the combination of drive assemblies 45 and guiding members 98 should occur sufficiently frequently to avoid buckling of the semi-rigid fin, fin 44 is also laterally positioned over its full length relative to flange 34 of I-beam 33. Thus, while semi-rigid fin 44 can be gradually bent or laterally deflected over a long distance, the deflection between adjacent guiding members 98 or between guiding members 98 and drive assemblies 45 is minimal. Fin rigidity, therefore, can be employed not only to drive and brake vehicle 22, but also as part of an assembly for steering vehicle 22 along support flanges 34 and support structure 21. It will be understood, however, that semi-rigid fin 44 can simply be attached to a non-steerable portion of the vehicle and used solely for vehicle propulsion. Steering, therefore, can be accomplished by other conventional means independently of fin 44. Conversely, fin 44 could be used only as part of a steering assembly, with the vehicle being propelled by other conventional means. Semi-rigid fin 44, therefore, can be considered as a drive fin, steering fin or, most preferably, a drive and steering fin. Moreover, as set forth below, fin 44 also is part of a safety assembly.

Figure 7A:
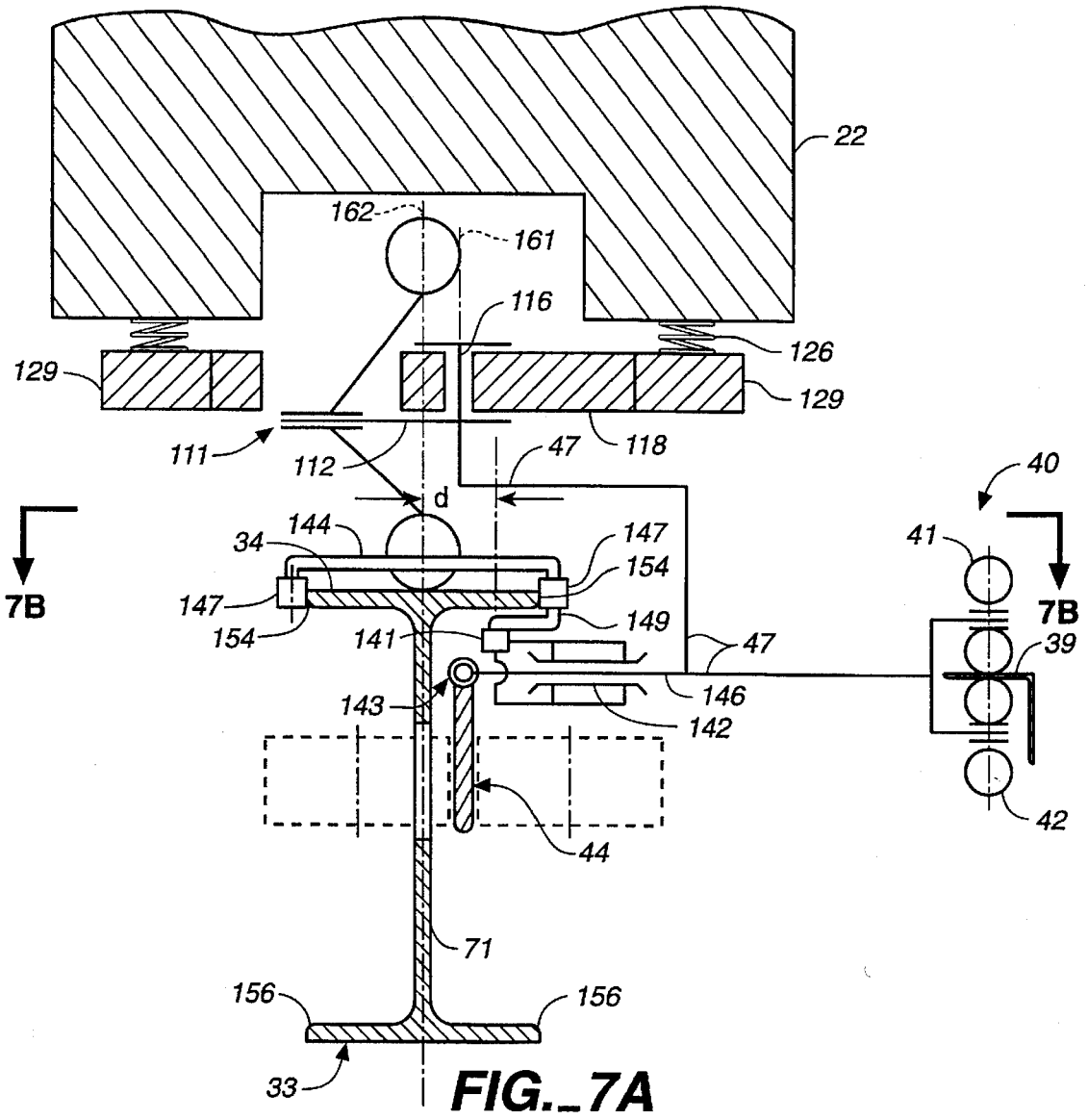
FIG. 7A is an end elevation schematic view corresponding to FIG. 7 and illustrating a steering control assembly suitable for use with the present invention.

Referring now to FIGS. 5, 7 and 7A, the suspension function of undercarriage assembly 43 of the present invention can be described in greater detail. Load-supporting wheel 36 is supported by an axle assembly, generally designated 111, including a U-shaped or wishbone member 112 that is bolted at 113 to downwardly sloping and transversely extending outrigger arm 47. A substantially vertically oriented king pin or steering axle 116 is mounted to an end 117 of another transverse arm 118 extending from the vehicle chassis or load supporting framework 133. Wishbone member 112 and king pin or steering axle 116 are mounted for relative pivoting about an axis 161 which is substantially vertically oriented.

Figure 7B:
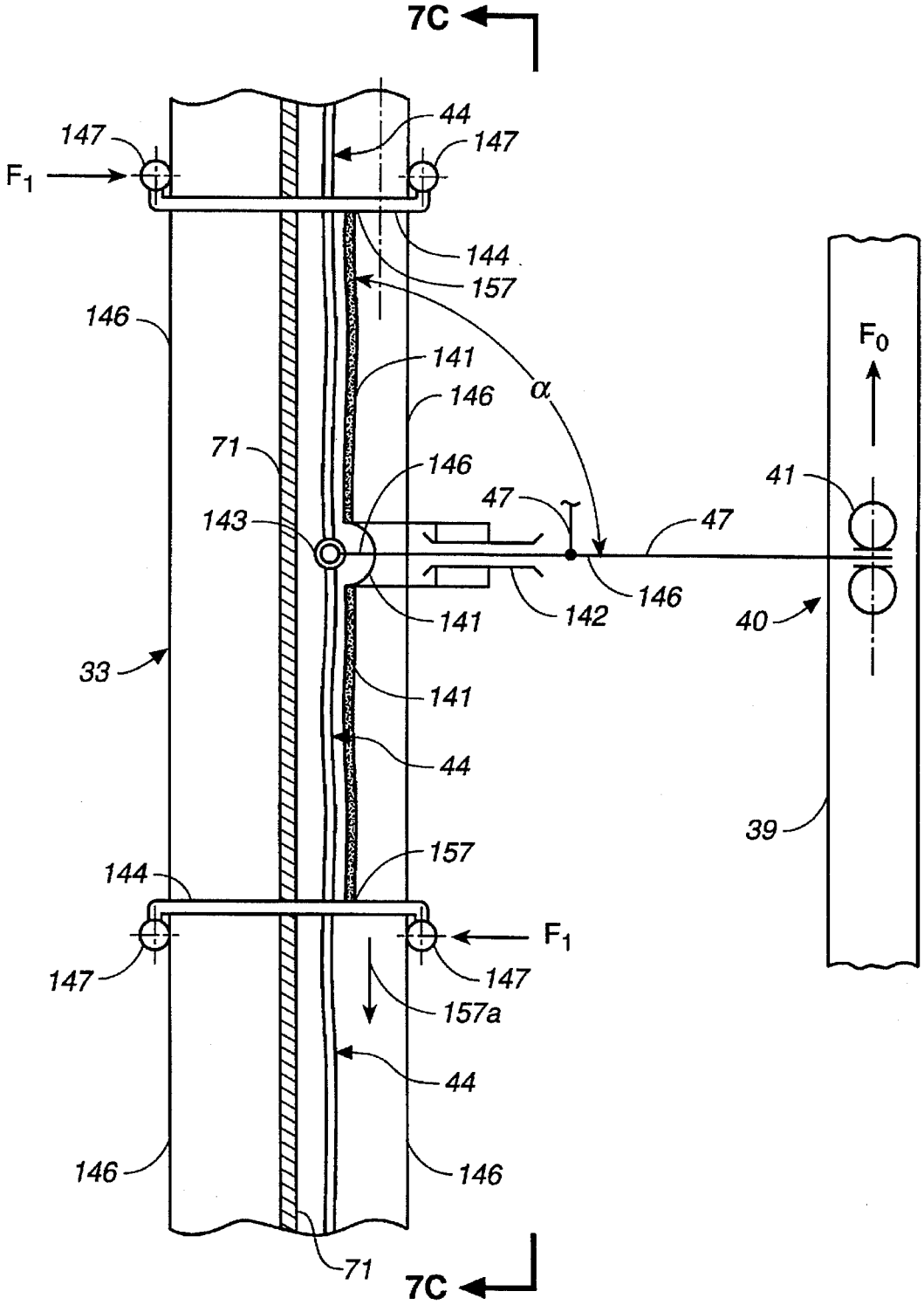
FIG. 7B is a top plan schematic view taken substantially along the plane of line 7B—7B in FIG. 7A.
Figure 7C:
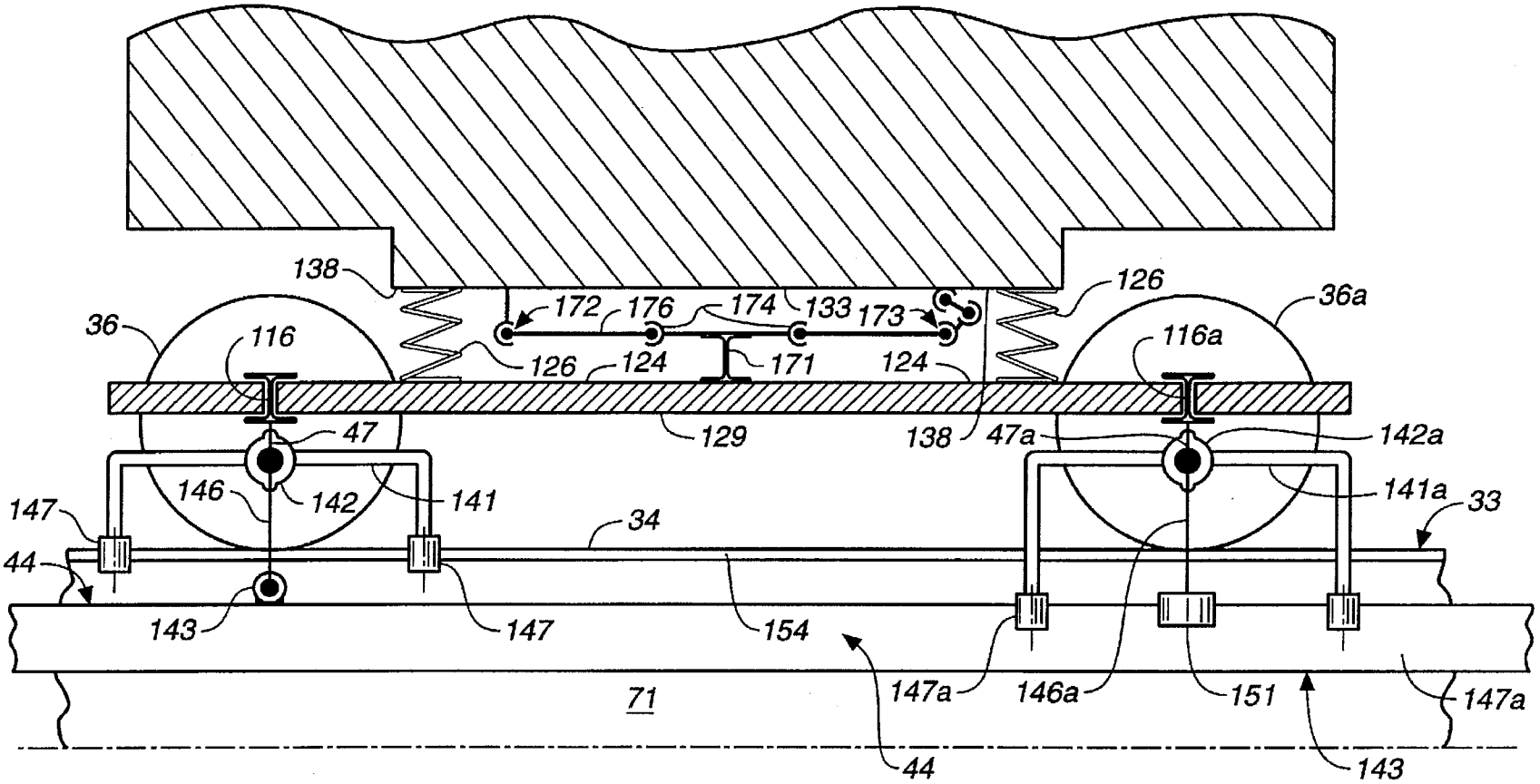
FIG. 7C is a side elevation schematic view taken substantially along the plane of line 7C—7C in FIG. 7B.

Chassis arm 118 extends inwardly and rearwardly from load-supporting wheel 36 until it reaches an inner end 123. An upper surface 124 of arm inner end 123 supports pneumatic spring 126, while a lower surface 127 of arm end 123 supports a downwardly extending post 128 which is attached to longitudinally extending beam member 129. As best can be seen in FIGS. 5 and 7C, beam member 129 extends longitudinally under the floor of vehicle cabin 122 to rear wheel **36*a***.

Also mounted to a forward end of framework 133 is an upward extending post 134, which is behind spring 126 and has a transverse horizontal beam 136 mounted thereto. A second post (not shown) is provided at the other side of frame member 133, and the second post extends and is secured to the other end of transverse beam 136. Beam 136 supports the weight of the vehicle through a second beam and pivot assembly, as well as a second pneumatic spring, provided outside wheel 36 at the other end of transverse beam 136.

Since vertical post 134 is behind pneumatic spring 126, a horizontally extending cantilevered member 137 (FIG. 5) extends out over pneumatic spring 126. A lower or downwardly facing surface 138 of horizontal extension 137 engages the upper surface of pneumatic spring 126 and cooperates with upwardly facing surface 124 to compress spring 126 therebetween.

As thus constructed, two beams 129 on opposite sides of the vehicle will compress two pneumatic springs 126 between surfaces 138 and 124 on opposed members 137 and end 123 of arm 118. Such vertical displacement of beam 129 upwardly and downwardly against pneumatic springs 126 suspends the vehicle weight resiliently with respect to load-supporting tire 36. The same undercarriage assembly 43 can be used to support the rear end of frame 133 with respect to rear wheel **36*a***.

In FIG. 7C one form of stabilizing linkage between framework 133 and longitudinal beams 129 is shown. A T-member 171 can be secured to beams 129 and have ball or flexible bushings 174 mounted to the opposite arms of the T-member. Links 176 extend longitudinally from T-member 171 in opposite directions and are coupled to framework 133 by coupling assemblies 172 and 173. As shown, a three pivot coupling assembly 173 of the type widely used in the automotive industry is shown, but it is believed that a rubber bushing or block also could accommodate the necessary displacement while ensuring that displacement of springs 126 is maintained along a substantially vertical axis.

Other forms of vehicle suspension are suitable for use in the present invention, and the suspension assembly is not regarded as a novel feature of the present invention.

A form of steering assembly suitable for use in the vehicle of the present invention can be described by reference to FIGS. 7, 7A, 7B and 7C. As seen in FIGS. 7 and 7A, axle assembly 111 and outrigger arm 47 are mounted for pivotal movement about king pin 116 and pivot axis 161 which effects turning of wheel 36 on upper flange 34 of I-beam 33. In FIG. 7B pivoting of outrigger arm 47 will be seen to result in change of the angle $\propto$ of arm 47 with respect to fin 44 and the sides or edges upper flange 34 of I-beam 33. In FIG. 7B, upper flange 34 is removed to show fin 44 and steering bar 141, but it will be understood that edges 156 of the lower beam flange and edges 154 of upper flange 34 (FIGS. 7A and 7C) typically will be vertically superimposed. Accordingly, by controlling angle $\propto$ between arm 47 and chassis member 129, steering of wheel 36 can be effected.

As shown in FIGS. 7, 7A and 7B control/adjustment of angle $\propto$ and steering of vehicle 22 is accomplished using guide rollers 147 which roll on edges 154 of upper I-beam flange 34. Mounted to extend longitudinally along a side proximate I-beam 33 is elongated steering bar 141. Bar 141 may have a transverse cross section as shown in FIG. 7 to resist lateral bending about a vertical axis and preferably has a length of several feet, e.g., 5 feet. Ends 157 of steering bar 141 have transversely extending arms 144, which span across the top of flange 34, mounted thereto. An extension arm 149 secures one end of arms 144, and rollers 147, to steering bar 141 and as noted above, guide rollers 147 ride on, and are guided by, opposed edges 154 of flange 34.

Steering bar 141 is coupled to outrigger arm 47 by a bushing assembly 142, which is slidably mounted on arm 146 that extends from outrigger arm 47. The bushing is located between the ends of bar 141 and is formed to permit axial displacement of arm 47 and arm 146 toward or away from ball joint 143 by which arm 47 is coupled to fin 44. Bar 141 is maintained in a known position relative to the I-beam by guide rollers 147. If steering bar 141 is pivoted about a vertical axis, for example, as a result of a horizontal curve in the track or I-beam 33, such pivoting will be transmitted from steering bar 141 by bushing 142 to outrigger arm 47. Pivoting of arm 47 about joint 143 in turn causes pivoting of wheel 36 about king pin 116 relative to vehicle chassis 129 and framework 133. Thus, as guide rollers 147 follow beam edges 154, steering bar 141 pivots or tilts causing arm 47 to pivot about king pin 116 and wheel 36 to be steered along flange 34.

Assuming that vehicle 22 is travelling in the direction of arrow **157*a* in FIG. 7B, outrigger assembly 40 will produce a drag force at the end of arm 47 in the direction of arrow $F_0$, which also will tend to decrease angle $\propto$ and turn wheel 36 on flange 34. Guide rollers 147, however, will similarly produce net reactive forces, as indicated by arrows $F_1$, that will tend to offset and equalize $F_0$. It also is advantageous to have steering bar 141 offset toward outrigger assembly 40 from the plane 162 of turning of wheel 36 by an amount, d, shown in FIG. 7A to equalize the effect of drag forces. Since precise dynamic balancing is not possible, therefore, particularly when considering wind loading and the like, guide wheels 147**, therefore, provide the necessary dynamic couple to balance the dynamic drag forces of the outrigger, guide rollers, wind loading, etc.

The vehicle of the present invention can be steered using a steerable front wheel only, as above described, but in the preferred form vehicle 22 has a steerable front wheel 36 and a steerable rear wheel **36*a*. As may be seen in FIG. 7C, rear wheel 36*a* is mounted to king pin 116*a*, and a steering bar 141*a* extends longitudinally and is coupled to an outrigger arm 47*a* by a coupling bushing 142*a*, in the manner described for front wheel 36**.

Since longitudinal vehicle beams 129 do not bend on curves, but fin 44 does, coupling 151 between arm **146*a* and fin 44 must be capable of sliding or moving with respect to fin 44. Again, the displacement longitudinally on curves will be small, e.g. 0.030 inches, coupling 151** could be a rubber coupling instead of a slidable connection.

In the steering assembly for front wheel 36, vehicle steering is effected by steering off of beam edges 154. In the assembly for rear wheel **36*a* semi-rigid fin 44 is used to steer vehicle 22. Steering bar 141*a* is coupled to guide rollers 147*a* which ride the sides of fin 44, instead of flange edges 154. Thus, a guide roller, or slide, can engage opposite sides of fin 44 at each end of steering bar 141. The rollers 147*a* do not roll along fin 44 because the fin and steering bar travel together with vehicle 22. Rollers 147*a* (or slides) need only accommodate the elongation of the fin relative to the fixed length steering bar 141** on curves.

As described above for front wheel 36, when a horizontal curve in support track 21 is encountered, fin 44 will be caused to deflect by a combination of drive assemblies 45 and fin guide assemblies 98. Curvature induced in fin 44 will be "seen" by guide rollers **147*a* and steering bar 141*a* will be pivoted. This, in turn, causes pivoting of arm 47*a*, through bushing 142*a* and arm 146*a*, with the result that rear wheel 36*a* is steered by semi-rigid fin 44**.

In the transportation system of the present invention, therefore, the guided, semi-rigid fin 44, can be used as a steering mechanism, either alone or in combination with steering off of the support structure. It is believed that use of the semi-rigid fin to effect, at least in part, vehicle steering will enable the rigid nature of the fin to smooth curves or diminish uncomfortable lateral cabin accelerations. The fin length, in combination with its rigidity and guidance, allow anticipation and smoothing of curves.

As will be further appreciated, however, the steering assembly for rear wheel **36*a* can be identical to that of wheel 36, with the exception that a coupling 151** should be included to accommodate relative longitudinal displacement which occurs on curves.

While the drive fin and steering fin concepts of the present invention are applicable to vehicles 22 which are supported from a pair of front wheels and a pair of rear load-supporting wheels, as is conventionally the case, the transportation system of the present invention preferably further includes a vehicle in which the vast majority of the load of the vehicle is supported by a front load-supporting wheel 36 and a rear load-supporting wheel **36*a*. Thus, vehicle 22 preferably is constructed with a bicycle-like, load-supporting assembly in which the great majority, and preferably about 90 percent or more, of the vehicle weight is supported on a front load-supporting wheel 36 and a rear load-supporting wheel 36*a*. As can be seen in FIGS. 3 and 4, the aligned load-supporting wheels 36 and 36*a* are preferably, but not necessarily, aligned and located proximate the center of the width dimension of cabin 122, again so that most of the weight can be supported by wheels 36 and 36*a***.

In order to control roll of two-wheeled vehicle 22 about load-supporting wheels 36, 36*a*, transverse outrigger arm 47 has a guide wheel or roll-control assembly, generally designated 40, mounted thereto. The guide wheel assembly, as above described, includes a pair of wheels 41 and 42 which are rotatably mounted on axles 151 to mounting plate 152 provided on the inner end 153 of arm 47. Rolling of vehicle 22, therefore, about load-supporting wheels 36, 36*a* is prevented by guide wheels 41 and 42, which engage L-shaped guiding member 39 laterally spaced from load-supporting flange 34. Some weight may be supported by guide wheels 41 and 42, but this weight will typically be ten percent, or less, of the total vehicle weight.

Figure 6:
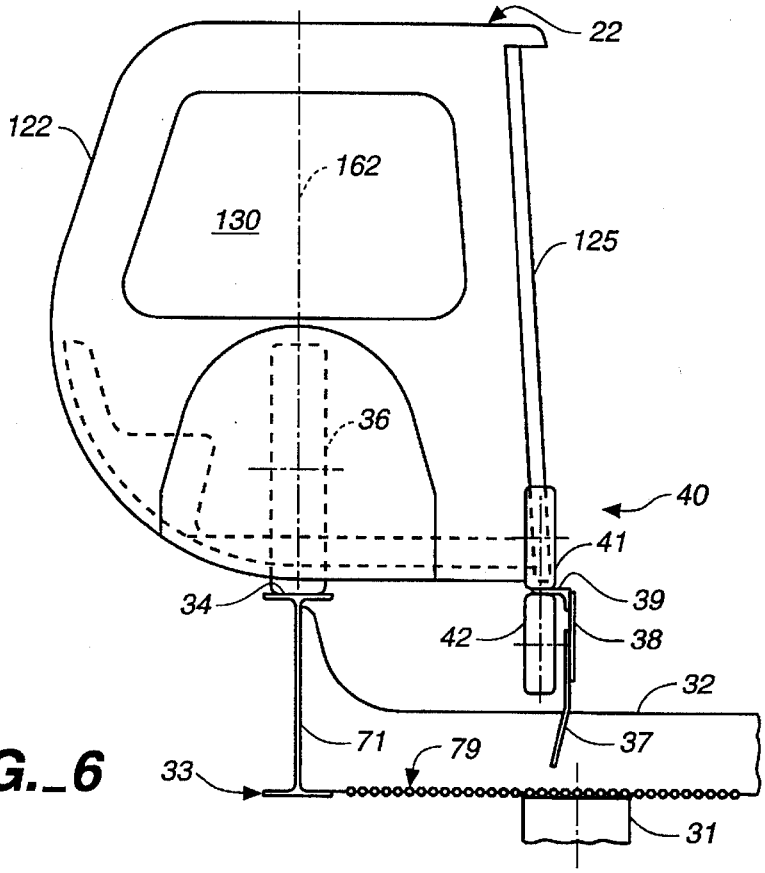
FIG. 6 is an end elevation view of a vehicle of FIG. 3 with the vehicle propulsion assembly not shown for ease of understanding.
Figure 6A:
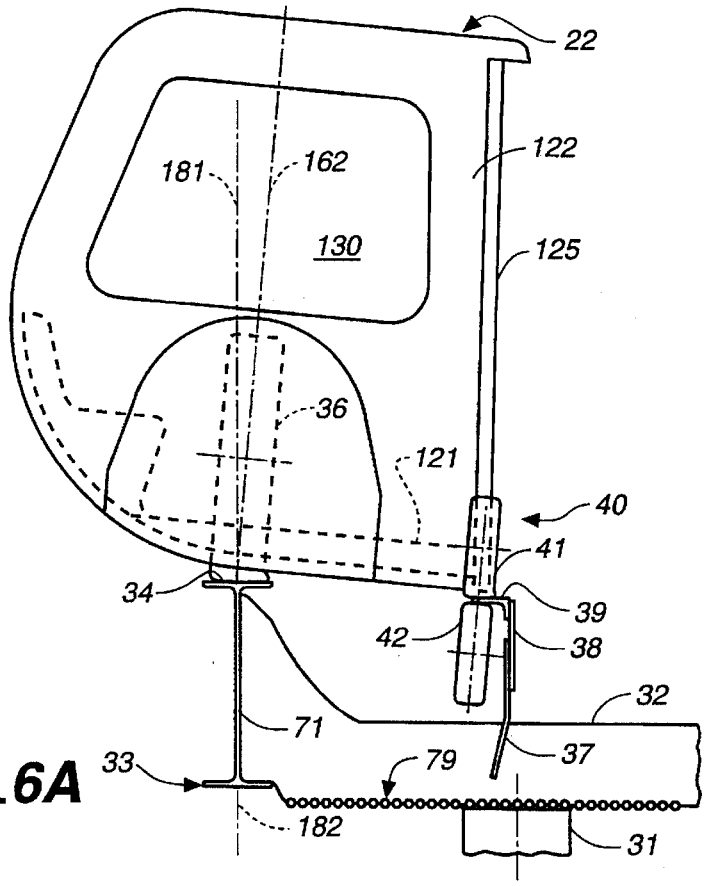
FIG. 6A is an end elevation view corresponding to FIG. 6 showing construction of the track and orientation of the vehicle on a turn.

One of the important advantages of the bicycle-type, load-supporting wheel assembly of the transportation vehicles of the present invention can be understood by comparison of FIGS. 6 and 6A. Undercarriage assembly 43 of vehicle 22 has been eliminated for clarity of illustration. In FIG. 6, vehicle 22 is travelling on a level trackway as would be typical in a non-curve section. Load-supporting wheels 36, 36*a* are riding flange 34, while roll control wheels 41 and 42 on outrigger arm assembly 40 roll along guiding flange 39. Preferably, both load-supporting wheels have an outrigger assembly 40 to stabilize cabin 122 at the front and rear of the vehicle. A single outrigger also could be employed.

FIG. 6A, by contrast, shows vehicle 22 in a horizontally curved track section. In order to offset the centrifugal force on vehicle 22 in a curve, it is preferable to tilt the vehicle inwardly, as shown by inward tilting of plane 162 of wheel 36 from a vertical plane 181 running through the center of I-beam 33. The inward tilting to accommodate centrifugal force can be accomplished using the bicycle-type, load-supporting system of the vehicle of the present invention simply by raising or lowering the relative positions of flange 34 and guiding or roll control surface 39. Much in the same manner as a bicycle accommodates inward tilting on the curves by compression of the inner side of the wheel and frictional forces between the bottom of the tire with support surface 34, it is not necessary for either support flange 34 or guiding flange 39 to be tilted. Both flanges 34 and 39, therefore, are oriented in a substantially horizontal plane in FIG. 6A, and tilting is accomplished simply by changing the relative elevations of these surfaces. Wheels 36, 41 and 42 easily accommodating the relative small angular changes required to provide comfort to the passengers in a horizontal curve. As shown in FIG. 6A, flange 34 has been elevated relative to guide member 39, but it will be appreciated that the guide member 39 can also be lowered to effect tilting relative to flange 34.

Similarly, curves in the opposite direction can be accommodated by raising or lowering either flange 34 and/or guide flange 39. Since the lateral position of vehicle 22 on flange 34 is being controlled by steering bar 141 off of one of semi-rigid fin 44 and beam edges 154, the vehicle is not free to move laterally on either of flange 34 or guiding member 39. The relative vehicle tilting can be accommodated, however, by mounting drive assemblies 45 and/or guide assemblies 98 on I-beams 33 at an angle corresponding to the angle of tilt. This can be relatively easily and inexpensively accomplished, however, while precisely tilting flanges 34 and 39 on a horizontal curve will entail very substantial expense. Moreover, the expense is increased when a grade or vertical curve also is present in the track.

Thus, the use of a bicycle-type or two-wheel, load-supporting assembly for vehicles 22 allows track or support structure 21 to be fabricated with horizontally curved and/or vertically curved second sections at much less expense than is required for vehicles in which the entire track must be tilted for curves. This tilting is required, for example, for magnetic levitation and hover craft tracks, and it combines with the requirement for extremely precise track elevation to greatly increase the cost of the support structure over the cost which can be achieved using the transportation system of the present invention.

In a final aspect of the present apparatus, fin 44 provides part of a safety structure for vehicle 22. As can be seen in FIG. 7, transverse arm 146 and ball joint 143 are coupled to semi-rigid fin plate 49 at a position underneath top I-beam flange 34. Extending outwardly over flange 34 is a hook member 182, which curves around under the side of flange 34 opposite to fin 44. Thus, hook 182 and fin/arm 44/146 encircle a sufficient portion of flange 34 to prevent the vehicle from falling or being steered completely off I-beam 33 in the event of a steering failure or other malfunction.

Having described the apparatus of the present invention, three aspects of the method of the present invention can be described.

In a first aspect, a method of driving a transportation vehicle 22 along a support structure 21 is provided which includes the steps of mounting an elongated semi-rigid fin to vehicle 21, with the fin having a length dimension greater than the length dimension of vehicle 22 and less than the length dimension of track 21.

The next step in the method of driving vehicle 22 is the step of supporting semi-rigid fin 44 at longitudinal locations along support structure 21 to combine with fin rigidity to prevent buckling of fin 44 under compression loading forces. This is accomplished by laterally supporting fin 44 by a combination of drive assemblies 45, fin support assemblies 98 and/or trolleys 91.

Finally, the method of driving a vehicle includes the step of applying compression forces to semi-rigid fin 44 through drive assemblies 45, which frictionally engage the fin to effect one of braking or propelling of the vehicle. The drive assemblies additionally may apply tension or traction forces to fin 44.

The ability to apply both compression and tension forces to a long, semi-rigid fin 44 allows the vehicles in the present transportation system to be driven independently of each other and yet allows the drive assemblies to apply sufficient braking and propulsion forces to achieve desirable velocity profiles in the shorter transit paths typical of automated people mover applications.

In some applications, and most advantageously shuttles, the driving method further includes the step of coupling a flexible traction belt 86 between semi-rigid fins 44 to form an endless loop.

In a second aspect a method of lateral guiding or steering of transportation vehicle 22 on track 21 is provided. The steering method again includes the step of supporting an elongated semi-rigid fin 44 from vehicle 22. Most preferably the fin has a length greater than the vehicle and extends at least forwardly of the vehicle. Next, the step of coupling fin 44 to a steering assembly of the vehicle for transmission of steering forces to the vehicle is accomplished. Thus, steering bar 141*a* and arm 146*a* to a steerable outrigger arm 47*a*, and steering bar 141*a* is coupled to follow lateral displacements of fin 44 by rollers 147*a* on either side of fin 44 and at opposite ends of steering bar 141*a*.

Finally, the method of steering using semi-rigid fin 44 includes the step of guiding the lateral position of semi-rigid fin 44 relative to support structure 21 as vehicle 22 is propelled along said support structure.

In a final aspect of the present invention, a method for supporting a vehicle 22 on a support structure 21 is provided which includes the step of supporting a substantial majority of the weight of vehicle 22 on a pair of longitudinally spaced apart and substantially aligned load supporting wheels 36 and 36*a*. The load supporting method further includes the step of controlling roll orientation of vehicle 22 by an outrigger arm 47 which extends laterally away from wheels 36, 36*a* to rollingly engage a guiding surface, such as flange 39 with wheel assembly 40. Preferably, 80 to 90 percent, or more, of the weight of vehicle 22 is supported on wheels 36, 36*a*, while about 20 to 10 percent, or less, of the weight is supported on outrigger wheel assembly 40.

The load supporting aspect of the method of the present invention allows super elevation without tilting of either I-beam flange 34 or guide flange 39, which greatly reduces the cost of constructing support structure 21.

As will be appreciated, the method of the present invention contemplates making various combinations of the driving, steering and supporting method steps, with the most preferred form of the method combining all three aspects of the method.

What is claimed is:

1. A transportation system comprising:

a vehicle support structure extending along a transit path;

a vehicle supported on said support structure for movement along said support structure, said vehicle having a vehicle length dimension along said support structure;

an elongated semi-rigid fin attached to said vehicle for transmission of driving forces along said support structure to said vehicle, said fin being sufficiently rigid and yet sufficiently continuously flexible about a vertical axis to assume a smooth continuous horizontal curvature along a horizontally curved portion of the transit path and said fin having a fin length dimension along said support structure greater than said vehicle length and less than the length of said support structure, and said fin extending from at least one of a forward end and a rearward end of said vehicle;

a plurality of drive assemblies positioned along said support structure to engage opposite sides of said fin, said drive assemblies applying compression forces to said fin in a direction along said support structure to effect at least one of propulsion and braking of said vehicle; and said fin being sufficiently rigid for braking and propulsion of said vehicle by said compression forces applied by said drive assemblies without lateral buckling of said fin under compression loading.

2. The transportation system as defined in claim 1, and a plurality of fin guide members positioned along said support structure to engage and support opposite sides of said fin as said fin and vehicle move along said support structure to cooperate with the rigidity of said fin to prevent lateral buckling of said fin under compression loading.

3. The transportation system as defined in claim 1 wherein, said fin has a length not more than about ten times said vehicle length, and said fin extends from a forward end of said vehicle by at least one said vehicle length; and said drive assemblies are formed to apply both tension and compression forces to said fin.

4. The transit system as defined in claim 3, and a laterally flexible traction belt attached to a forward end and a rearward end of said fin and extending from said fin over the full length of said support structure.

5. The transit system as defined in claim 4 wherein, said traction belt extends in a loop from said forward end to said rearward end of said fin.

6. The transit system as defined in claim 5 wherein, said support structure is formed in a shuttle configuration for shuttling of at least one said vehicle back and forth between stations proximate opposite ends of said support structure.

7. The transportation system as defined in claim 1 wherein, said fin is sufficiently rigid to influence lateral steering of said vehicle on said support structure through engagement and lateral positioning of said fin;

said vehicle having a steering assembly; and said fin being coupled to said steering assembly.

8. The transport system as defined in claim 7 wherein, lateral positioning of said fin is effected in part by said drive assemblies.

9. The transport system as defined in claim 7, and a plurality of fin guide members positioned along said support structure to engage and support opposite sides of said fin to effect lateral positioning of said fin to assist in steering of said vehicle on said support structure.

10. The transit system as defined in claim 7 wherein, said fin has a length not more than about ten times said vehicle length, and said fin extends from a forward end of said vehicle by at least one said vehicle length.

11. The transportation system as defined in claim 7 wherein, said fin is sufficiently laterally flexible to bend laterally around a turn having a radius of about 40 feet.

12. The transportation system as defined in claim 7, and a lateral guide assembly coupled to said fin and formed to guide the lateral position of said fin relative to said support structure as said fin moves along said support structure.

13. The transportation system as defined in claim 12 wherein, said lateral guide assembly is provided by a roller assembly rollingly engaging said support structure.

14. The transportation system as defined in claim 1 wherein, said fin is formed from a steel plate having a thickness dimension of at least 0.25 inches and a height dimension of at least about six inches.

15. The transportation system as defined in claim 14 wherein, said steel plate is covered with a rubber layer on opposed sides thereof for frictional engagement by said drive assemblies.

16. The transportation system as defined in claim 15 wherein, said drive assemblies include a drive wheel resiliently biased into driving engagement with said rubber layer.

17. The transportation system as defined in claim 15 wherein, said rubber layer is sufficiently resiliently compressible for driving by said drive assemblies, and said drive assemblies having a pair of drive wheels spaced apart in fixed locations at a distance less than a thickness dimension of said fin including said rubber layer on each side of said steel plate.

18. The transportation system as defined in claim 1 wherein, said fin extends both forwardly and rearwardly of said vehicle by at least about one said vehicle length.

19. The transportation system as defined in claim 18 wherein, said fin extends both forwardly and rearwardly of said vehicle by a distance equal to at least two said vehicle lengths; and a fin support trolley assembly attached to said fin both forwardly and rearwardly of said vehicle, said fin support trolley assembly being formed for movable support of the weight of said fin on said support structure as said fin and said vehicle move along said support structure.

20. The transportation system as defined in claim 19 wherein, said fin support trolley assembly is further formed to guide the lateral position of said fin as said fin and said vehicle move along said support structure.

21. A transportation system comprising;

a support structure extending along a path;

a vehicle supported on said support structure for movement therealong, said vehicle having a steering assembly formed for lateral steering of said vehicle to follow said support structure and said vehicle having a length along said support structure;

an elongated semi-rigid fin attached to said steering assembly for steering of said vehicle, said semi-rigid fin having a length substantially greater than said vehicle length and extending parallel to said support structure from a forward end of said vehicle, said semi-rigid fin having sufficient lateral rigidity to influence steering of said vehicle laterally on said support structure and having sufficient continuous lateral flexibility to bend at a radius at least equal to a smallest radial horizontal curve on said support structure; and a plurality of fin guiding assemblies positioned along said support structure to engage opposite sides of said semi-rigid fin to laterally position said semi-rigid fin relative to said support structure.

22. The transportation system as defined in claim 21 wherein, said semi-rigid fin has a length not greater than about ten vehicle lengths and extends at least one said vehicle length in front of said vehicle and at least one said vehicle length behind said vehicle.

23. The transportation system as defined in claim 22 wherein, said semi-rigid fin is sufficiently rigid to both influence steering of said vehicle and to drive and brake said vehicle using compression loading in a direction along the length of said semi-rigid fin without fin buckling;

said semi-rigid fin is attached to said vehicle for transmission of driving forces to said vehicle; and a plurality of drive assemblies positioned along said support structure to frictionally engage and drive said semi-rigid fin.

24. The transportation system as defined in claim 23 wherein, said drive assemblies also function as said fin guiding assemblies spaced along said support structure and positioned to laterally position and support said semi-rigid fin.

25. The transportation system as defined in claim 24 wherein, said fin guiding assemblies are positioned intermediate said fin drive assemblies.

26. The transportation system as defined in claim 21 wherein, said vehicle includes a front wheel assembly rotatably mounted to said vehicle proximate a front end thereof and mounted to said steering assembly for steering of said front wheel assembly about a substantially vertical axis, and a rear wheel assembly mounted to said vehicle proximate a rear end thereof by a second steering assembly formed for steering of said rear wheel assembly about a substantially vertical axis; and said semi-rigid fin being attached to both said steering assembly for said front wheel assembly and said second steering assembly for simultaneous influence of the steering of both said front wheel assembly and said rear wheel assembly upon lateral bending of said semi-rigid fin.

27. The transportation system as defined in claim 26 wherein, said front wheel assembly includes a single load support wheel, an outrigger extending laterally of said load supporting wheel, and at least one roll control wheel mounted to said outrigger to rotatably engage a guiding surface on said support structure for orientation of said vehicle during movement about a longitudinally extending roll axis positioned proximate engagement of said load support wheel with said support structure.

28. The transportation system as defined in claim 21 wherein, said vehicle has a front wheel assembly with a load supporting front wheel and a rear wheel assembly with a load supporting rear wheel, said front wheel and said rear wheel being mounted to said vehicle in substantial axial alignment for travel on said support structure along substantially the same track; and said steering assembly is provided as a front wheel steering assembly mounting said front wheel for steering about a substantially vertically oriented axis.

29. The transportation system as defined in claim 28, and a rear wheel steering assembly mounted to said vehicle and mounting said rear wheel for steering about a substantially vertically oriented axis; and said semi-rigid fin being coupled to both said front wheel steering assembly and said rear wheel steering assembly.

30. The transportation system as defined in claim 29 wherein, said support structure includes a longitudinally extending guide surface; and said front wheel assembly includes a front outrigger arm extending laterally of said load supporting front wheel, and a front roll control wheel assembly mounted to said front outrigger arm and formed to engage said guide surface on said support structure to control roll orientation of said vehicle about a roll axis proximate a central plane of contact of said front wheel with said support structure.

31. The transportation system as defined in claim 30 wherein, said rear wheel assembly includes a rear outrigger arm extending laterally of said load supporting rear wheel, and a rear roll control wheel assembly mounted to said rear outrigger arm and formed to engage said guide surface on said support structure to control roll orientation of said vehicle about a roll axis proximate a central plane of contact of said rear wheel with said support structure.

32. The transportation system as defined in claim 31 wherein, said front wheel and said rear wheel support at least eighty percent of the load of said vehicle on said support structure.

33. The transportation system as defined in claim 28, wherein, said front wheel steering assembly includes a steering bar that is adapted to be guided by said support structure and impart a moment to said front wheel steering assembly in response to a curvature in said support structure and in a manner not effecting the lateral coupling between said fin and said front wheel steering assembly.

34. The transportation system as defined in claim 21 wherein, said vehicle is rollingly supported on a load-supporting flange on said support structure by a bicycle wheel assembly including only two load supporting wheels and at least one outrigger assembly engaging a guiding surface on said support structure to control roll orientation of said vehicle about said flange.

35. The transportation system as defined in claim 34 wherein, said two load supporting wheels are sufficiently large in diameter and said vehicle is formed to support at least ninety percent of the load of said vehicle on load supporting wheels.

36. The transportation system as defined in claim 34 wherein, said support structure includes a track provided by upper flanges of a longitudinal assembly of a plurality of I-beams, and said load supporting wheels roll on said upper flanges.

37. The transportation system as defined in claim 34 wherein, said outrigger assembly includes a pair of opposed roll control wheels positioned to engage upper and lower guide surfaces of a horizontally extending guide flange on said support structure.

38. The transportation system as defined in claim 34 wherein, said guiding surface is vertically offset with respect to said flange in areas of horizontal curves and both said load supporting flange and said guiding surface are substantially horizontally oriented.

39. The transportation system as defined in claim 21 wherein, said fin guiding assemblies are formed for sliding contact with said semi-rigid fin.

40. The transportation system as defined in claim 21 wherein, said fin guiding assemblies are formed for rolling contact with said semi-rigid fin.

41. The transportation system as defined in claim 21, and a lateral guide assembly coupled to said semi-rigid fin and formed to engage said support structure to assist in lateral guiding of said semi-rigid fin.

42. The transportation system as defined in claim 41 wherein, said lateral guide assembly is formed for rolling engagement with said support structure.

43. The transportation system as defined in claim 41 wherein, said lateral guide assembly is provided by a fin-supporting trolley mounted for guided movement along said support structure.

44. The transportation system as defined in claim 21, and a flexible traction belt coupled to each of opposite ends of said semi-rigid fin and extending forwardly and rearwardly of said semi-rigid fin for propulsion of said vehicle in part by application of tension forces to said traction belt.

45. The transportation system as defined in claim 44 wherein, said traction belt extends in a loop from a forward end of said semi-rigid fin to a rearward end of said semi-rigid fin over the length of said transit support structure; and said support structure is configured as a shuttle system.

46. A vehicle for use in a transportation system comprising:

a vehicle body;

a pair of load-supporting wheels mounted for rotation to said body in longitudinally spaced relationship;

at least one outrigger roll control assembly mounted to said body and extending laterally of said wheels to engage a guide surface positioned laterally of said wheels;

a mounting assembly for coupling of a propulsion element to said vehicle to effect propulsion of said vehicle along a support structure;

wherein, at least one of said load-supporting wheels is mounted to a steering assembly for turning of said load supporting wheel about a vertical axis, and an elongated semi-rigid fin in a substantially vertical orientation and coupled to said steering assembly, said semi-rigid fin having a length greater than and extending forwardly of said vehicle.

47. The vehicle as defined in claim 46 wherein, said load-supporting wheels are substantially longitudinally aligned;

said load-supporting wheels are each mounted to their own steering assembly for turning about a vertical axis; and said semi-rigid fin is coupled to both said steering assemblies.

48. The vehicle as defined in claim 46 wherein, said mounting assembly is formed for coupling of a semi-rigid fin thereto in a vertical orientation for transmission of both steering and propulsion forces to said vehicle.

49. A method of laterally guiding a transportation vehicle having a length dimension on a support track during movement of said vehicle along said support track comprising the steps of:

supporting an elongated, continuously flexible semi-rigid fin from said vehicle;

coupling said semi-rigid fin to a steering assembly of said vehicle for transmission of steering forces to said vehicle; and guiding the lateral position of said semi-rigid fin relative to said support track as said vehicle is propelled along said support track to cause said vehicle to follow said semi-rigid fin as said vehicle is propelled along said support structure.

50. The method as defined in claim 49 wherein, said coupling step is accomplished by coupling said semi-rigid fin to a longitudinally extending steering bar connected to pivot said steering assembly about a vertical axis.

51. The method as defined in claim 49, and the step of:

propelling said vehicle along said support track by frictionally engaging and driving said semi-rigid fin with a plurality of drive assemblies positioned along said support track.

52. A method of supporting a transportation vehicle on a support structure for movement of said vehicle along said support structure comprising the steps of:

supporting a substantial majority of the weight of said vehicle on a pair of longitudinally spaced apart and substantially aligned load supporting wheels;

controlling roll orientation of said vehicle about said load supporting wheels by an outrigger assembly including an arm extending away from said load supporting wheels and a roll control assembly mounted to said arm and engaging a guiding surface spaced from said load supporting wheels, said step of controlling roll orientation of said vehicle being accomplished by rolling engagement of said roll control assembly with said guiding surface, and the step of:

steering said vehicle along said support structure using at least in part an elongated semi-rigid fin coupled to a steering assembly for said vehicle.

53. The method as defined in claim 52, and the step of:

propelling said vehicle along said support structure by frictionally engaging an elongated semi-rigid fin coupled to said vehicle for transmission of propulsion forces thereto.

54. The method as defined in claim 53 wherein, during said propelling step, steering said vehicle at least in part by using said semi-rigid fin.

55. A method of driving a transportation vehicle having a length dimension along a support structure over a transit path comprising the steps of:

mounting an elongated semi-rigid, continuously flexible fin to said vehicle, said fin having a length dimension greater than said length dimension of said vehicle and less than said support structure;

supporting said semi-rigid fin at longitudinal locations along said support structure sufficiently close together to combine with fin rigidity to prevent buckling of said semi-rigid fin under compression loading forces; and applying compression forces to said semi-rigid fin through drive assemblies frictionally engaging said semi-rigid fin to effect at least one of propelling and braking of said vehicle.

56. The method as defined in claim 55, and the step of:

influencing steering of said vehicle by controlling the lateral position of said semi-rigid fin during movement along said support structure.

57. The method as defined in claim 55, and the step of:

coupling a flexible traction belt to said semi-rigid fin for propelling said vehicle at least in part by application of tension forces to said traction belt.

58. The method as defined in claim 57 wherein, said coupling step is accomplished by coupling a loop of traction belt to said semi-rigid fin with one end of said traction belt being coupled to one end of said semi-rigid fin and an opposite end of said traction belt being coupled to an opposite end of said semi-rigid fin.

59. The method as defined in claim 55, and the step of:

supporting a majority of the weight of said vehicle on a pair of longitudinally spaced and substantially aligned load-supporting wheels and controlling roll orientation about said load-supporting wheels using an outrigger arm having a rolling wheel assembly thereon in rolling engagement with a guide surface laterally spaced from said load-supporting wheels.

60. A transportation system comprising:

a vehicle support structure extending along a transit path;

a vehicle supported on said support structure for movement along said support structure, said vehicle having a vehicle length dimension along said support structure;

an elongated semi-rigid fin attached to said vehicle for transmission of driving forces along said support structure to said vehicle, said fin having a fin length dimension along said support structure greater than said vehicle length and less than the length of said support structure, and said fin extending from at least one of a forward end and a rearward end of said vehicle;

said fin being sufficiently rigid for braking and propulsion of said vehicle by said compression forces applied by said drive assemblies without lateral buckling of said fin under compression loading;

a laterally flexible traction belt attached to a forward end and a rearward end of said fin and extending from said fin over the full length of said support structure; and a drive mechanism coupled to said flexible traction belt for propelling said flexible traction belt along the transit path.

61. The transportation system of claim 60, wherein, said drive mechanism comprises a bull wheel around which said flexible traction belt is entrained.

62. A drive fin for use in a transportation system including a vehicle support structure extending along a transit path and at least one vehicle supported on the support structure for movement along the transit path, the vehicle having a vehicle length dimension along the support structure, the drive fin comprising:

an elongated semi-rigid fin attached to the vehicle for transmission of driving forces along the support structure to the vehicle, said fin being sufficiently continuously flexible about a vertical axis to assume a curvature of the transit path, said fin having a fin length dimension along said support structure greater than the vehicle length and less than the length of the support structure, said fin extending from said vehicle in the direction of vehicle movement along the support structure, and said fin being sufficiently rigid for braking and propulsion of the vehicle by compression forces applied by a drive mechanism without lateral buckling of said fin under compression loading.

* * * * *